US011519179B2

(12) United States Patent
Hale et al.

(10) Patent No.: US 11,519,179 B2
(45) Date of Patent: Dec. 6, 2022

(54) ATTACHING AN ASSEMBLED WALL MODULE TO A BUILDING STRUCTURE

(71) Applicant: RBD HOLDINGS LLC, Alexander, AR (US)

(72) Inventors: Robert Hale, Alexander, AR (US); David Reed, Hensley, AR (US)

(73) Assignee: RBD HOLDINGS LLC, Alexander, AR (US)

( * ) Notice: Subject to any disclaimer, the term of this patent is extended or adjusted under 35 U.S.C. 154(b) by 0 days.

(21) Appl. No.: 17/238,423

(22) Filed: Apr. 23, 2021

(65) Prior Publication Data

US 2021/0372133 A1 Dec. 2, 2021

Related U.S. Application Data

(63) Continuation-in-part of application No. 17/082,770, filed on Oct. 28, 2020, now Pat. No. 11,391,037.

(60) Provisional application No. 63/031,268, filed on May 28, 2020.

(51) Int. Cl.

| | |
|---|---|
| ***E04F 13/08*** | (2006.01) |
| ***E04B 1/35*** | (2006.01) |
| ***E04B 2/56*** | (2006.01) |

(52) U.S. Cl.

CPC ..... *E04F 13/0807* (2013.01); *E04B 1/355* (2013.01); *E04B 2/56* (2013.01); *E04F 13/0875* (2013.01); *E04B 2001/3588* (2013.01)

(58) Field of Classification Search

CPC .. E04F 13/0807; E04F 13/0875; E04B 1/355; E04B 2/56; E04B 2001/3588; E04G 21/167

See application file for complete search history.

(56) References Cited

U.S. PATENT DOCUMENTS 3,808,761 A * 5/1974 Green ..... E04B 2/56 52/643
5,265,396 A * 11/1993 Amimoto ..... E04F 13/0855 52/235
5,313,752 A * 5/1994 Hatzinikolas ..... E04B 2/58 52/690
5,333,435 A * 8/1994 Leek ..... E04B 1/2608 52/712

(Continued)

*Primary Examiner* — Rodney Mintz
(74) *Attorney, Agent, or Firm* — Haynes and Boone, LLP

(57) ABSTRACT

Apparatus, systems, and methods for attaching an assembled wall module to a building structure, according to which a framing section, including a plurality of structural members and a first coupler connected to a first structural member of the plurality of structural members, is connected to the building structure. After connecting the framing section to the building structure, relative movement is permitted, via the first coupler, between the framing section and the building structure in a first direction. Before connecting the framing section to the building structure, a plurality of sheeting sections may be connected to the framing section. The framing section may further include a second coupler; in such instances, after connecting the framing section to the building structure, relative movement is permitted, via the second coupler, between the framing section and the building structure in a second direction, which second direction is the same as the first direction.

14 Claims, 23 Drawing Sheets

(56) References Cited

U.S. PATENT DOCUMENTS 5,664,392 A * 9/1997 Mucha ..... E04B 2/96 52/285.3
5,720,571 A * 2/1998 Frobosilo ..... E04B 2/96 403/231
5,846,018 A * 12/1998 Frobosilo ..... E04F 13/0808 403/231
5,876,006 A * 3/1999 Sharp ..... E04B 1/2403 248/297.21
5,906,080 A * 5/1999 diGirolamo ..... E04B 2/96 52/656.1
6,088,982 A * 7/2000 Hiesberger ..... E04B 1/2608 403/231
6,098,364 A * 8/2000 Liu ..... E04F 13/0855 52/235
6,612,087 B2 * 9/2003 diGirolamo ..... E04C 3/07 52/712
6,688,069 B2 * 2/2004 Zadeh ..... E04B 1/2403 52/715
7,104,024 B1 * 9/2006 diGirolamo ..... E04B 2/96 403/231
7,478,508 B2 * 1/2009 Peterson ..... E04B 2/96 248/300
7,503,150 B1 * 3/2009 diGirolamo ..... E04B 2/96 52/703
8,181,419 B1 * 5/2012 diGirolamo ..... E04B 2/768 52/712
8,511,032 B2 * 8/2013 Abdel-Rahman ..... E04B 2/88 52/573.1
8,615,942 B2 * 12/2013 Lafreniere ..... E04B 2/766 52/715
9,032,681 B1 * 5/2015 Brady ..... E04B 2/88 52/404.1
9,115,489 B2 * 8/2015 Bourdon ..... E04B 1/36
9,534,371 B2 * 1/2017 Judd ..... E04B 1/40
10,036,160 B2 * 7/2018 Judd ..... E04B 2/58
10,041,288 B1 * 8/2018 Flood ..... E04B 2/44
10,724,229 B2 * 7/2020 Daudet ..... E04B 1/2403
10,961,704 B2 * 3/2021 Daudet ..... E04B 2/789
11,261,598 B2 * 3/2022 Hale ..... E04G 21/142
11,391,037 B2 * 7/2022 Hale ..... E04G 21/167
2002/0062617 A1 * 5/2002 diGirolamo ..... E04C 3/07 52/688
2006/0096192 A1 * 5/2006 Daudet ..... E04B 1/24 52/204.1
2009/0193750 A1 * 8/2009 Klima ..... E04B 2/96 52/712
2013/0139466 A1 * 6/2013 Abdel-Rahman ..... E04B 2/88 52/655.1
2013/0255178 A1 * 10/2013 Judd ..... E04B 1/40 52/646
2015/0068153 A1 * 3/2015 Bourdon ..... E04F 13/28 52/702
2015/0308098 A1 * 10/2015 Tessadori ..... E04F 13/0807 52/698
2017/0016239 A1 * 1/2017 Judd ..... E04H 9/021
2018/0135293 A1 * 5/2018 Daudet ..... E04B 1/2403
2021/0372118 A1 * 12/2021 Hale ..... E04G 21/142
2021/0404173 A1 * 12/2021 Hale ..... E04G 21/167

* cited by examiner

ATTACHING AN ASSEMBLED WALL MODULE TO A BUILDING STRUCTURE

CROSS-REFERENCE TO RELATED APPLICATION

The present application is a continuation-in-part ("CIP") of U.S. application Ser. No. 17/082,770, filed Oct. 27, 2020, which claims the benefit of the filing date of, and priority to, U.S. Application No. 63/031,268 (the "'268 Applications"), filed May 28, 2020, the entire disclosures of which are hereby incorporated herein by reference.

The present application also claims the benefit of the filing date of, and priority to, the '268 Applications.

TECHNICAL FIELD

The present application relates generally to wall systems and, more particularly, to an apparatus, system, and method for attaching an assembled wall module to a building structure.

BACKGROUND

The standard construction methodology for insulated metal panel ("IMP") cladding over a steel stud wall involves labor-intensive aerial construction of the stud wall followed by a similar construction process to install the metal panels. Most of this work must be performed by workers in boom lifts or other aerial working platforms with the materials being maneuvered into place using cranes. This standard construction methodology is an established, tried, and true process with known challenges and rate of work. However, such working conditions present serious fall risks for workers. Additionally, the workers are encumbered with 50-75 lbs. of gear while working and spend approximately half of their time getting into position to perform the work. Thus, the inefficiencies of working at a height that requires fall protection result in a prolonged job schedule. Therefore, what is needed is an apparatus, system, and/or method to address one or more of the foregoing issued, and/or one or more other issued.

BRIEF DESCRIPTION OF THE DRAWINGS

FIG. 2A-2 is a perspective view of the lifting apparatus of FIG. 2A-1 in the first operational state or configuration, according to one or more embodiments.

FIG. 2A-3 is an elevational view of the lifting apparatus of FIG. 2A-1 in the first operational state or configuration, according to one or more embodiments.

FIG. 2B-1 is a diagrammatic illustration of the lifting apparatus of FIG. 2A-1 in a second operational state or configuration, the lifting apparatus having been actuated from the first configuration to the second configuration by a crane, according to one or more embodiments.

FIG. 2B-2 is a diagrammatic illustration of the lifting apparatus of FIG. 2A-1 in the second operational state or configuration, the lifting apparatus having been actuated from the first configuration to the second configuration by one or more hydraulic cylinders, according to one or more embodiments.

FIG. 2B-3 is a perspective view of the lifting apparatus of FIG. 2B-1 in the second operational state or configuration, according to one or more embodiments.

FIG. 2B-4 is an elevational view of the lifting apparatus of FIG. 2B-1 in the second operational state or configuration, according to one or more embodiments.

DETAILED DESCRIPTION

The present disclosure introduces a modularized wall system that allows for entire wall modules to be constructed at ground level by workers without the need for fall protection. Most of the work of constructing the wall modules is done at ground level, resulting in the modularized wall system of the present disclosure being safer than the standard construction methodology described above by reducing the fall risk to the level of normal tripping hazards inherent to all construction activity. Further, workers are not required to wear heavy fall protection restraints or carry tools on their person, resulting in the modularized wall system of the present disclosure being more efficient than the standard construction methodology described above by enabling workers to get into position to perform their work in seconds rather than minutes. Further still, the modularized wall system of the present disclosure allows a portion of the structural work to be pre-fabricated ahead of time at an off-site location, resulting in the modularized wall system of the present disclosure being more efficient than the standard construction methodology described above. To achieve these advantages (and others), the modularized system of the present disclosure requires careful planning to prepare for the risks and challenges.

Figure 1A:
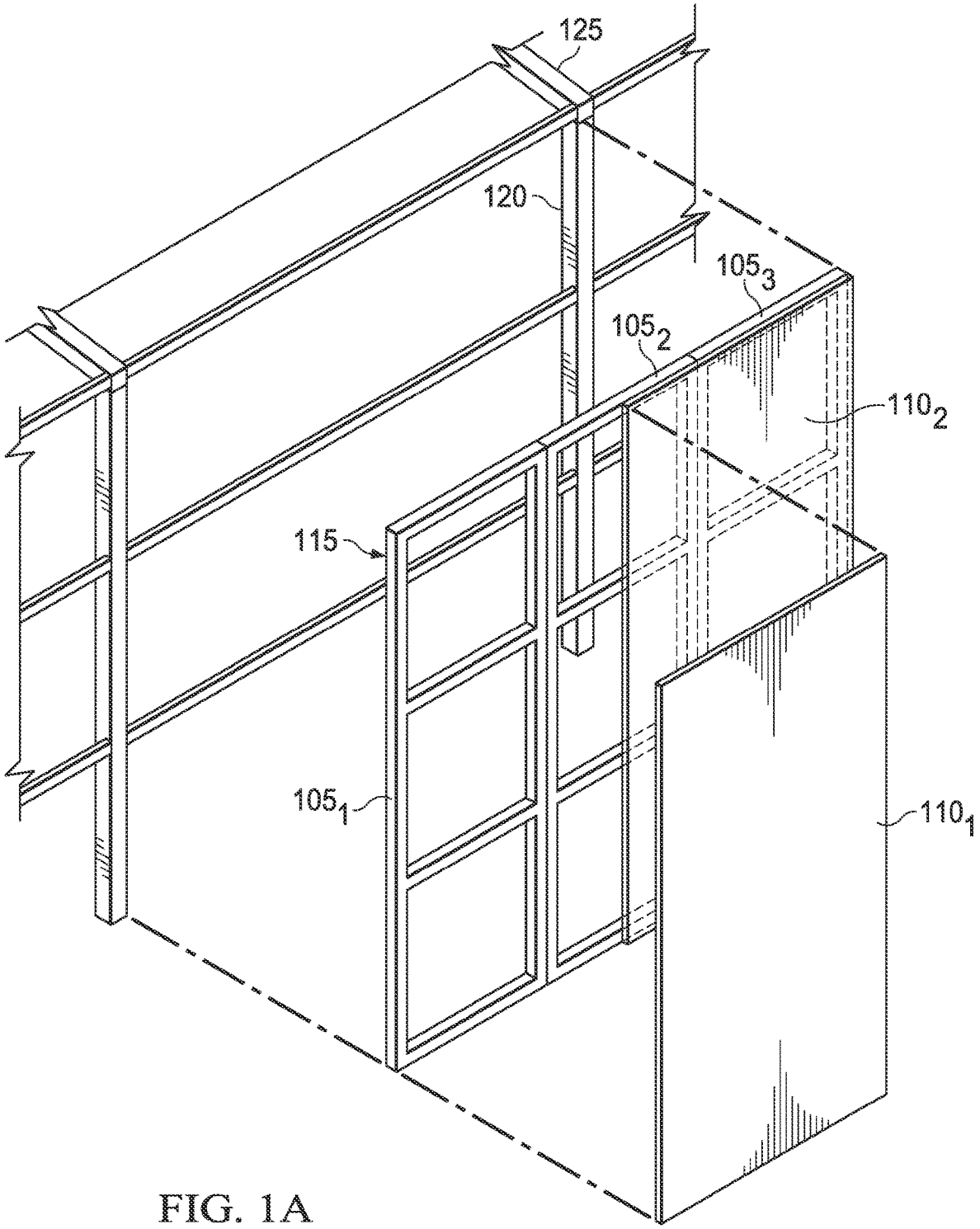
FIG. 1A is a simplified exploded perspective view of a building structure, a building substructure, and a wall module including framing sections and sheeting sections, according to one or more embodiments.
Figure 1B:
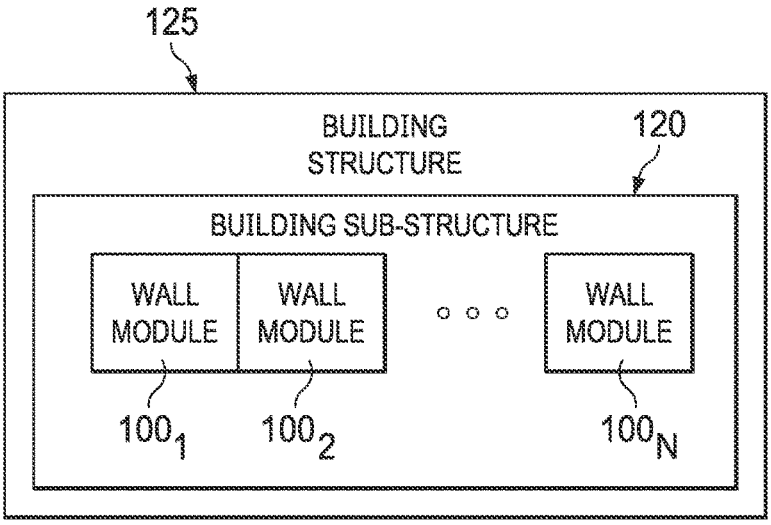
FIG. 1B is a diagrammatic illustration of the wall module of FIG. 1A installed onto the building sub-structure, according to one or more embodiments.
Figure 1C:
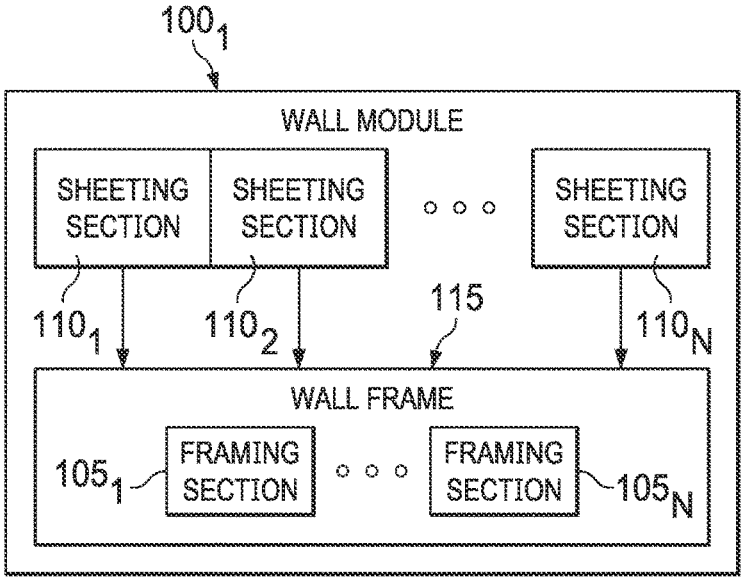
FIG. 1C is a diagrammatic illustration of the wall module of FIG. 1A, according to one or more alternative embodiments.

Referring to FIGS. 1A through 1C, in an embodiment, a wall module is generally referred to by the reference numeral $\mathbf{100}_1$. As shown in FIG. 1A, the wall module $\mathbf{100}_1$ includes framing sections $\mathbf{105}_{1\text{-}3}$ and sheeting sections $\mathbf{110}_{1\text{-}2}$. In some embodiments, the wall module $\mathbf{100}_1$ is or includes structural steel. As shown in FIG. 1A the sheeting sections $\mathbf{110}_{1\text{-}2}$ are attached to the framing sections $\mathbf{105}_{1\text{-}3}$ to form the wall module $\mathbf{100}_1$. More particularly, the framing sections $\mathbf{105}_{1\text{-}3}$ are constructed into an integrated wall frame 115 to which the wall sheeting sections $\mathbf{110}_{1\text{-}2}$ are attached. This construction allows the framing sections $\mathbf{105}_{1\text{-}3}$ to be prefabricated off site and then assembled into the wall frame 115 on site and at ground level. The wall module $\mathbf{100}_1$ can then be finished on site by attaching the sheeting sections $\mathbf{110}_{1\text{-}2}$ to the wall frame 115 at ground level, lifting the completed wall module $\mathbf{100}_1$ into place, as will be described in further detail herein, and securing the completed wall module $\mathbf{100}_1$ to a building sub-structure 120, which building sub-structure 120 is part of a building structure 125 such as, for example, a multi-story warehouse structure.

More particularly, as shown in FIG. 1B, in an embodiment, the wall module $\mathbf{100}_1$ and a plurality of additional wall modules $\mathbf{100}_{2\text{-}N}$ are adapted to be aligned with each other and secured to the building sub-structure 120. In some embodiments, the additional wall modules $\mathbf{100}_{2\text{-}N}$ are substantially identical to the wall module $\mathbf{100}_1$ described above in connection with FIG. 1A and, therefore, will not be described in further detail. The building sub-structure 120 to which the wall modules $\mathbf{100}_{1\text{-}N}$ are secured may be or include structural members such as, for example, wall columns, wall girts, wall purlins, wall bracing, the like, or a combination thereof.

Although shown in FIG. 1A and described above as including three framing sections $\mathbf{105}_{1\text{-}3}$, one or more of the wall modules $\mathbf{100}_{1\text{-}N}$ such as, for example, the wall module $\mathbf{100}_1$ shown in FIG. 1C (according to an alternative embodiment), may instead include one, two, four, or more framing sections $\mathbf{105}_{1\text{-}N}$, which framing sections $\mathbf{105}_{1\text{-}N}$ together form the wall frame 115. In addition, or instead, although shown in FIG. 1A and described above as including two sheeting sections $\mathbf{110}_{1\text{-}2}$, one or more of the wall modules $\mathbf{100}_{1\text{-}N}$ such as, for example, the wall module $\mathbf{100}_1$ shown in FIG. 1C (according to an alternative embodiment), may instead include one, three, or more sheeting sections $\mathbf{110}_{1\text{-}N}$ attached to the wall frame 115, as shown in FIG. 1C.

The wall modules $\mathbf{100}_{1\text{-}N}$ of the present disclosure are substituted in place of the steel studs used in conventional wall systems. As a result, the modularized wall system of the present disclosure: is stronger, delivering a better product; can be partially assembled off site; and creates a more rigid platform that allows for modularization of the wall frame 115 and the sheeting sections $\mathbf{110}_{1\text{-}N}$, as described herein. To achieve such modularization, each of the framing sections $\mathbf{105}_{1\text{-}N}$ of the wall frame 115 may be pre-fabricated in a controlled shop environment. For example, as in FIG. 1C, the wall frame 115 may contain multiple separate ones of the framing sections $\mathbf{105}_{1\text{-}N}$ to enable using standard methods of transport to the project site. In some embodiments, the framing sections $\mathbf{105}_{1\text{-}N}$ are or include structural steel. All welding is done in the shop and the framing sections $\mathbf{105}_{1\text{-}N}$ are checked for alignment prior to shipping. Once on site, the separate framing sections $\mathbf{105}_{1\text{-}N}$ are fastened together on a ground level platform (i.e., on the lifting apparatus described herein) to form the wall frame 115. The completed wall frame 115 is then ready for the sheeting sections $\mathbf{110}_{1\text{-}N}$ to be attached thereto before being rigged up and lifted into place for securing to the building structure 125, that is, the building sub-structure 120, as will be described in further detail below.

The construction of the wall frame 115 improves quality control by allowing tolerances, welds, and alignment to be verified in a well-lit, covered shop environment. Further, inspection is made more convenient by allowing the inspector to verify performance of the framing sections $\mathbf{105}_{1\text{-}N}$ and/or the integrated wall frame 115 with an inspection at any point during the construction process (prior to final installation) without requiring special accommodations to access the work (e.g., boom lifts, fall protection, etc.). Further still, as described above, the safety and efficiency of the work constructing the wall frame 115 is improved by minimizing the amount of work performed by personnel at heights requiring fall protection. Further still, the efficiency of equipment use is improved by minimizing the need for crane rigging, hoisting, and boom lift use. Finally, the construction of the wall frame 115 reduces labor costs, and, most significantly, shortens the overall construction schedule.

Additionally, the construction of the wall frame 115 achieves a strong, rigid frame that enables the installation of the sheeting sections $\mathbf{110}_{1\text{-}N}$ at ground level, that is, on the lifting apparatus described herein. In some embodiments, the sheeting sections $\mathbf{110}_{1\text{-}N}$ are insulated metal panels ("IMPs"). Conventionally, the installation of sheeting involves a minimum of an eight (8) man crew, two boom lifts, and a crane. Due to the complexities of working at such a height and the coordination required between all the equipment, the process is slow and laborious. However, with the implementation of the modular wall system described herein, the sheeting sections $\mathbf{110}_{1\text{-}N}$ can be fastened to the assembled wall frame 115 to complete the wall module $\mathbf{100}_1$ before rigging up the completed wall module $\mathbf{100}_1$ and lifting it into place for securing to the building structure 125, that is, the building sub-structure 120, as will be described in further detail below.

The ground level installation of the sheeting sections $\mathbf{110}_{1\text{-}N}$ improves quality control by allowing the completed work to be more closely examined from ground level prior to its being lifted into place. Further, inspection is made more convenient by allowing the inspector to verify performance with an inspection at any point during the constructions process (i.e., prior to final installation) without requiring special accommodations to access the work (e.g., boom lifts, fall protection, etc.). Further still, the safety and efficiency of the work installing the sheeting sections $\mathbf{110}_{1\text{-}N}$ is improved by minimizing the amount of work required to be performed by personnel at heights requiring fall protection. Further still, equipment use is decreased since the work installing the sheeting sections $\mathbf{110}_{1\text{-}N}$ can be performed with minimal crane rigging, hoisting, and boom lift use.

Installing the sheeting sections $\mathbf{110}_{1\text{-}N}$ onto the wall frame 115 at ground level before lifting the completed wall module $\mathbf{100}_1$ into position presents some challenges, including, for example: the need to protect the facade of the sheeting sections $\mathbf{110}_{1\text{-}N}$ during lifting and installation; the need to protect the sheeting sections $\mathbf{110}_{1\text{-}N}$ from excessive deflection during lifting; the need to align the completed wall modules $\mathbf{100}_{1\text{-}N}$ on the building structure 125, that is, the building sub-structure 120; and the need for site conditions permitting use of the modularized wall system of the present disclosure (including a sufficient staging area). The present disclosure addresses these challenges, especially those associated with protecting the sheeting sections $\mathbf{110}_{1\text{-}N}$ during lifting and installation, by providing a lifting apparatus and method for picking and lifting the wall modules $\mathbf{100}_{1\text{-}N}$ into position.

Figures 1, 2A:
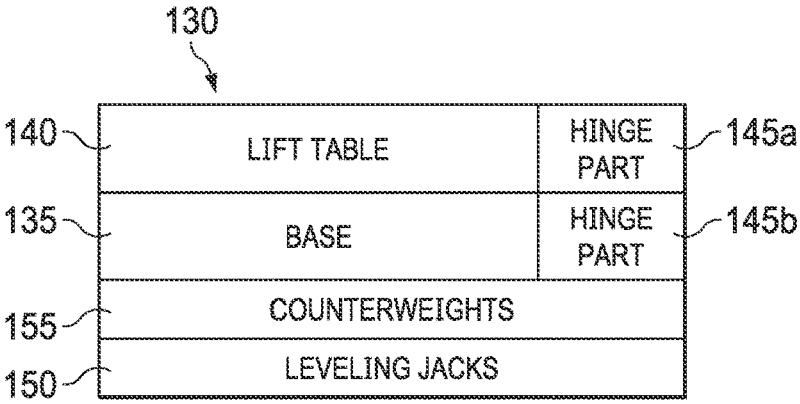
FIG. 2A-1 is a diagrammatic illustration of a lifting apparatus in a first operational state or configuration, according to one or more embodiments.
Figures 2, 2A:
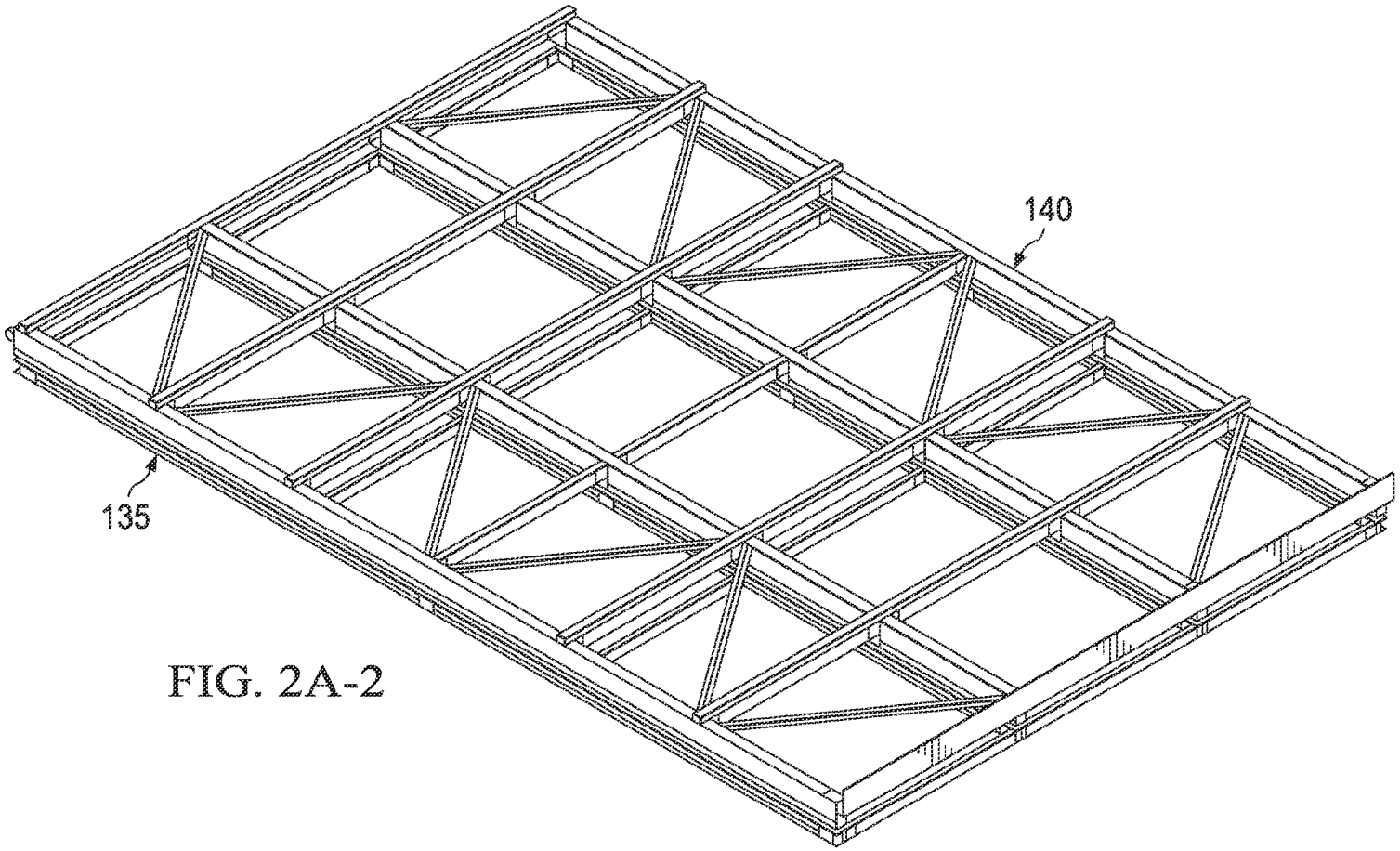
Figures 2, 2A, 3:
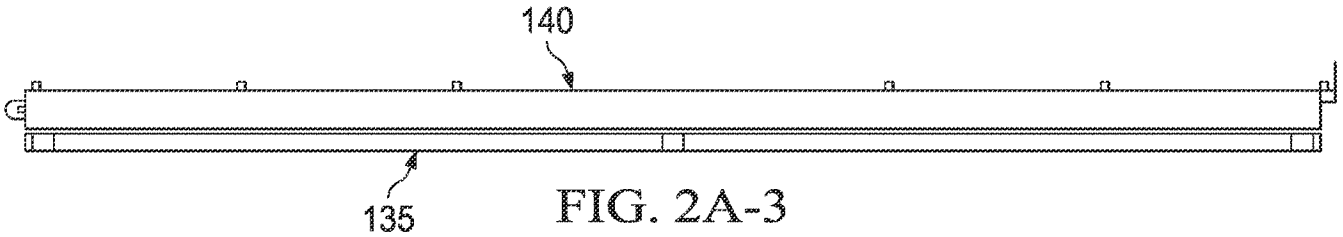

FIG. 2A-1 is a diagrammatic illustration of such a lifting apparatus, generally referred to by the reference numeral 130, in a first operational state or configuration (i.e., a "loading" configuration), according to one or more embodiments. Referring to FIG. 2A-1, in an embodiment, the lifting apparatus 130 includes a base 135 and a lift table 140. In some embodiments, in the first configuration, the lift table 140 and the base 135 are spaced in a parallel relation. The lift table 140 includes a hinge part 145*a*. The base 135 includes a hinge part 145*b*. The lift table 140 is hingedly connected to the base 135 via the hinge parts 145*a-b*. The lift table 140 is adapted to accommodate successive ones of the wall modules $\mathbf{100}_{1\text{-}N}$ described above in connection with FIGS. 1A and 1B. Additionally, the lifting apparatus 130 is constructed so that it can be leveled on site. More particularly, the lifting apparatus 130 includes a plurality of leveling jacks 150 secured to the base 135 and adapted to level the lifting apparatus 130 for each setup. The lifting apparatus 130 further includes a plurality of counterweights 155, which counterweights 155 are attached to the base 135 to hold the base 135 in position on site when the lifting apparatus 130 is actuated from the first configuration, as shown in FIG. 2A-1, to a second configuration, as will be shown and described below in connection with FIGS. 2B-1 through 2B-4. FIGS. 2A-2 and 2A-3 are perspective and elevational views, respectively, of the lift table 140 and the base 135 of FIG. 2A-1 in the first operational state or configuration, according to one or more embodiments. In some embodiments, as in FIGS. 2A-2 and 2A-3, the lifting apparatus 130 is constructed with bolted connections to allow for quick and easy disassembly and reassembly on the project site. Moreover, the lifting apparatus 130 is designed to allow it to be lifted with a crane once positioned on site. For example, a crawler crane may be used on site to position and subsequently re-position the lifting apparatus 130 for installation of successive ones of the wall modules $\mathbf{100}_{1\text{-}N}$, thus providing the option to pick and carry the lifting apparatus 130 to another location quickly and efficiently.

Figures 1, 2B:
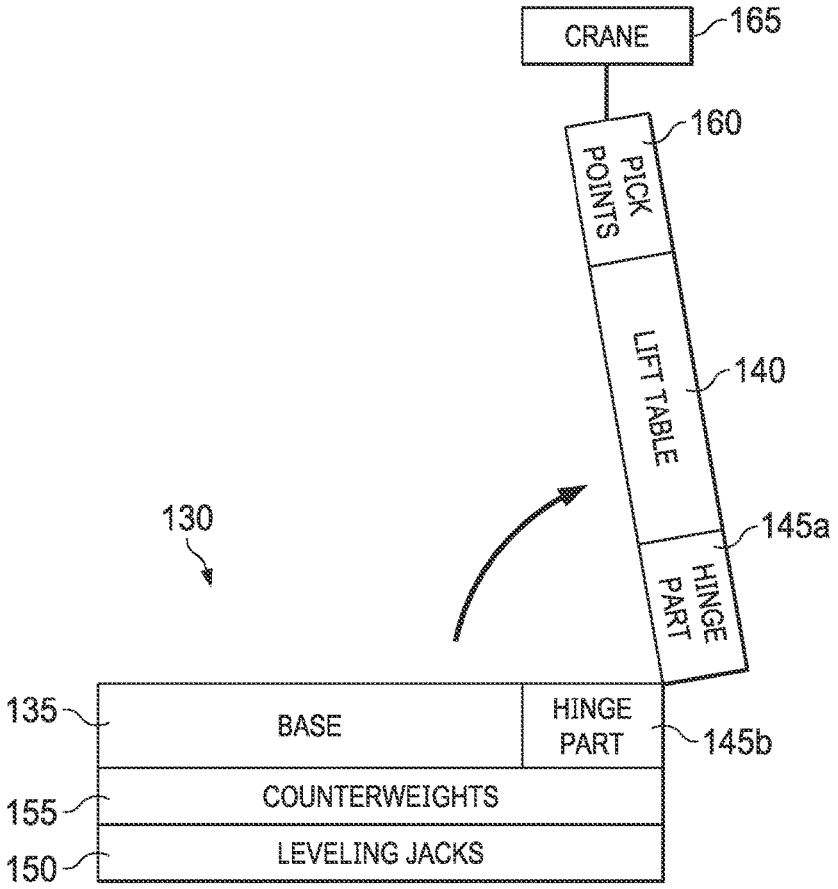
Figures 2, 2B:
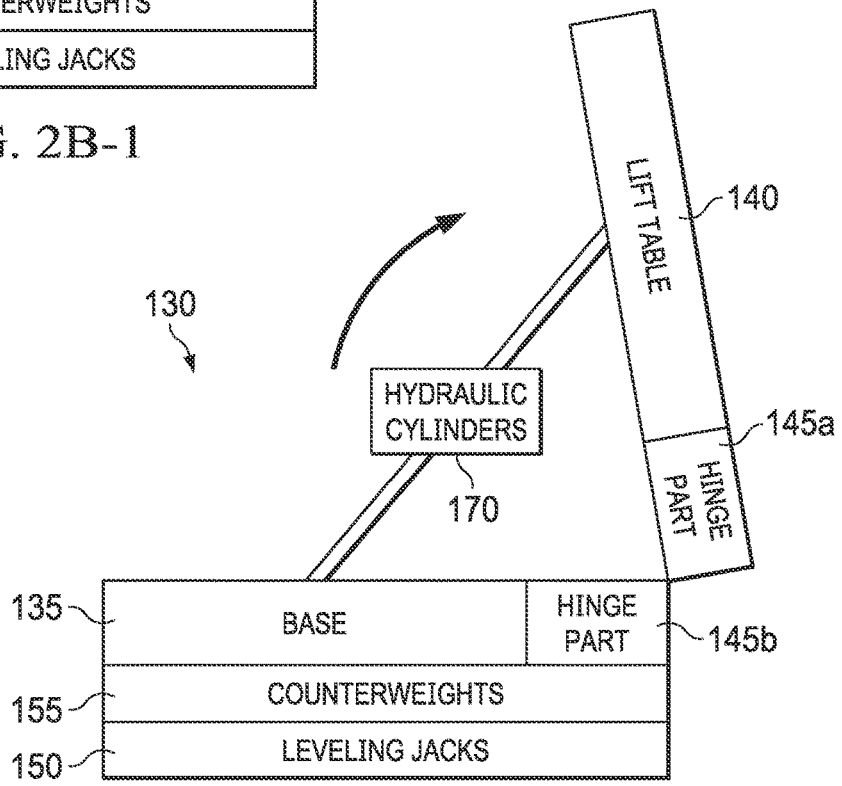
Figures 2, 2B, 3:
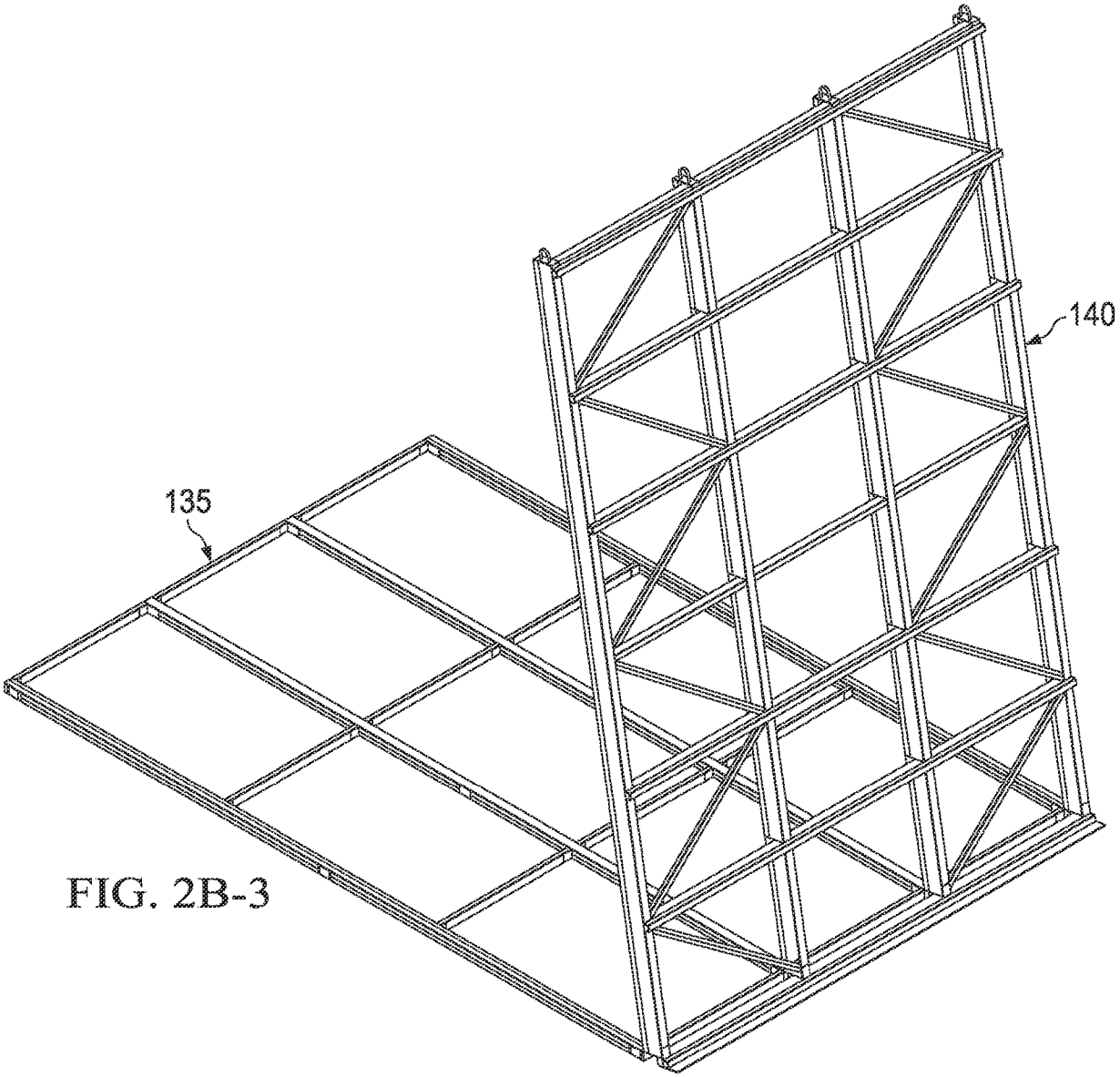
Figures 2, 2B, 3, 4:
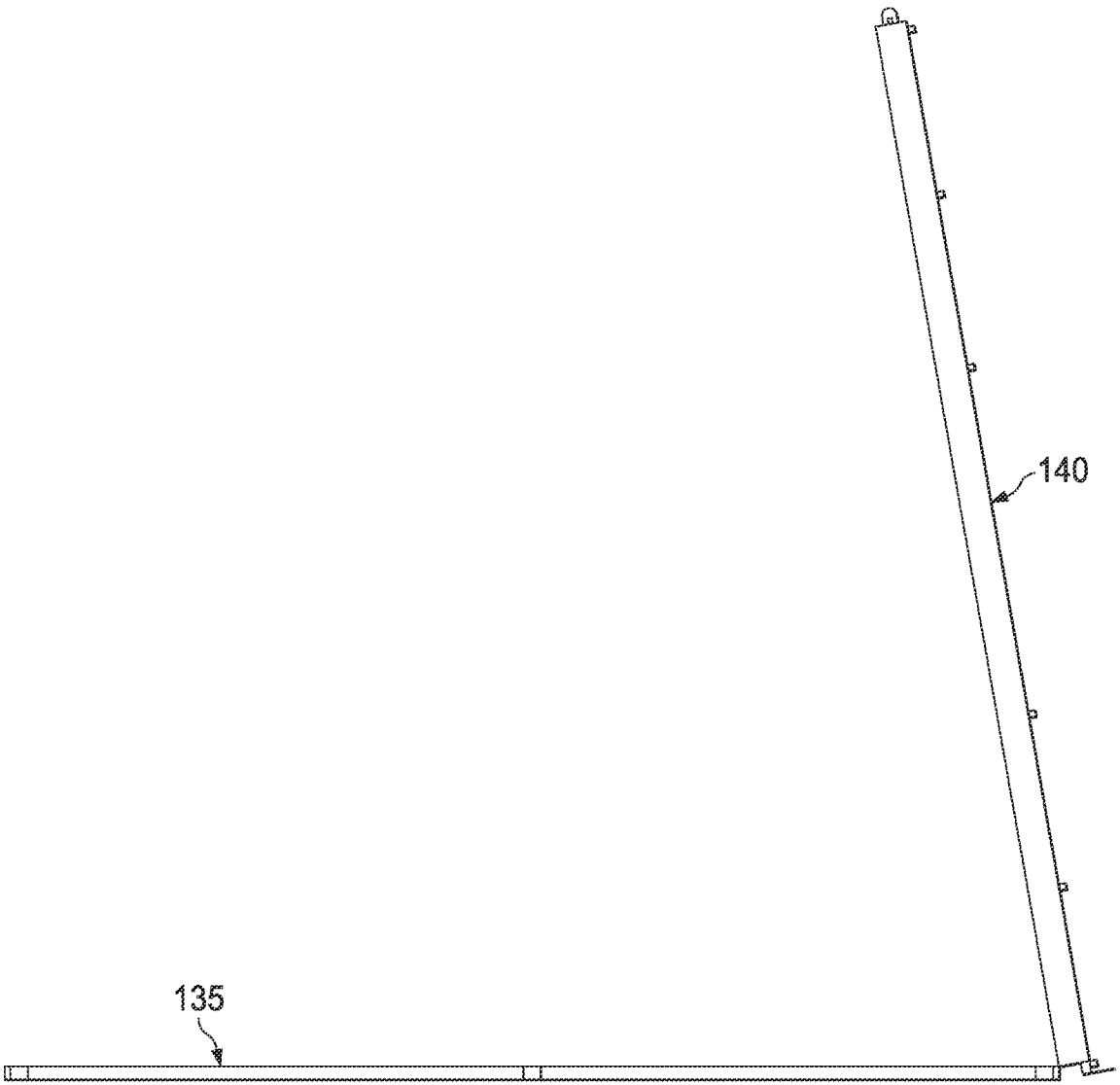

FIGS. 2B-1 and 2B-2 are diagrammatic illustrations of the lifting apparatus 130 of FIG. 2A-1 in a second operational state or configuration (i.e., an "unloading" configuration), according to one or more embodiments. In some embodiments, in the second configuration, the lift table 140 is spaced at an 80-degree angle from the base 135. Alternatively, the lift table 140 may be spaced at another angle from the base 135 in the second configuration, such as, for example, an angle in the range of 79 to 81-degrees, an angle in the range of 75 to 85-degrees, an angle in the range of 70 to 90-degrees, an angle of greater than 79 degrees, an angle of greater than 75 degrees, an angle of greater than 70 degrees, an angle of greater than 65 degrees, an angle of greater than 60 degrees, an angle of greater than 55 degrees, an angle of greater than 50 degrees, an angle of greater than 45 degrees, or another angle. Referring to FIG. 2B-1, in an embodiment, the lift table 140 includes pick points 160. The pick points 160 are adapted to be rigged to a crane 165 to enable the crane 165 to actuate the lifting apparatus 130 from the first configuration to the second configuration. More particularly, the pick points 160 are positioned opposite the hinge part 145*a* so that, when the crane 165 is rigged to the pick points 160 and hoists the lift table 140, the lift table 140 pivots about the hinge points 145*a-b* into the second configuration. Referring to FIG. 2B-2, in an alternative embodiment, the pick points 160 are omitted in favor of one or more hydraulic cylinders 170 connected between the base 135 and the lift table 140 to actuate the lifting apparatus 130 from the first configuration to the second configuration. FIGS. 2B-3 and 2B-4 are perspective and elevational views, respectively, of the lift table 140 and the base 135 of FIGS. 2B-1 and 2B-2 in the second operational state or configuration, according to one or more embodiments.

Figure 3A:
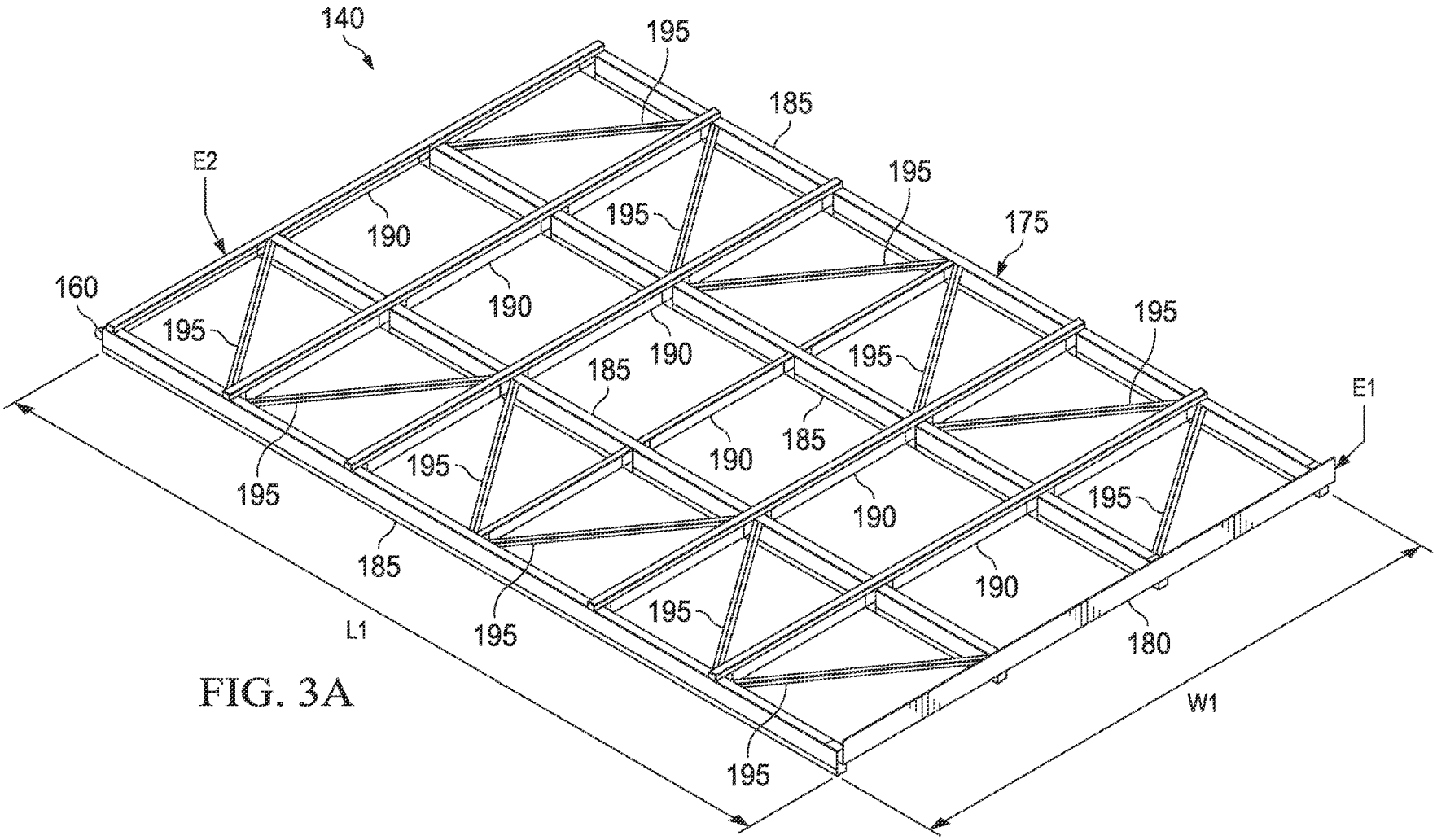
FIG. 3A is a perspective view of a lift table of the lifting apparatus of FIGS. 2A-1 through 2B-4, according to one or more embodiments.
Figure 3B:
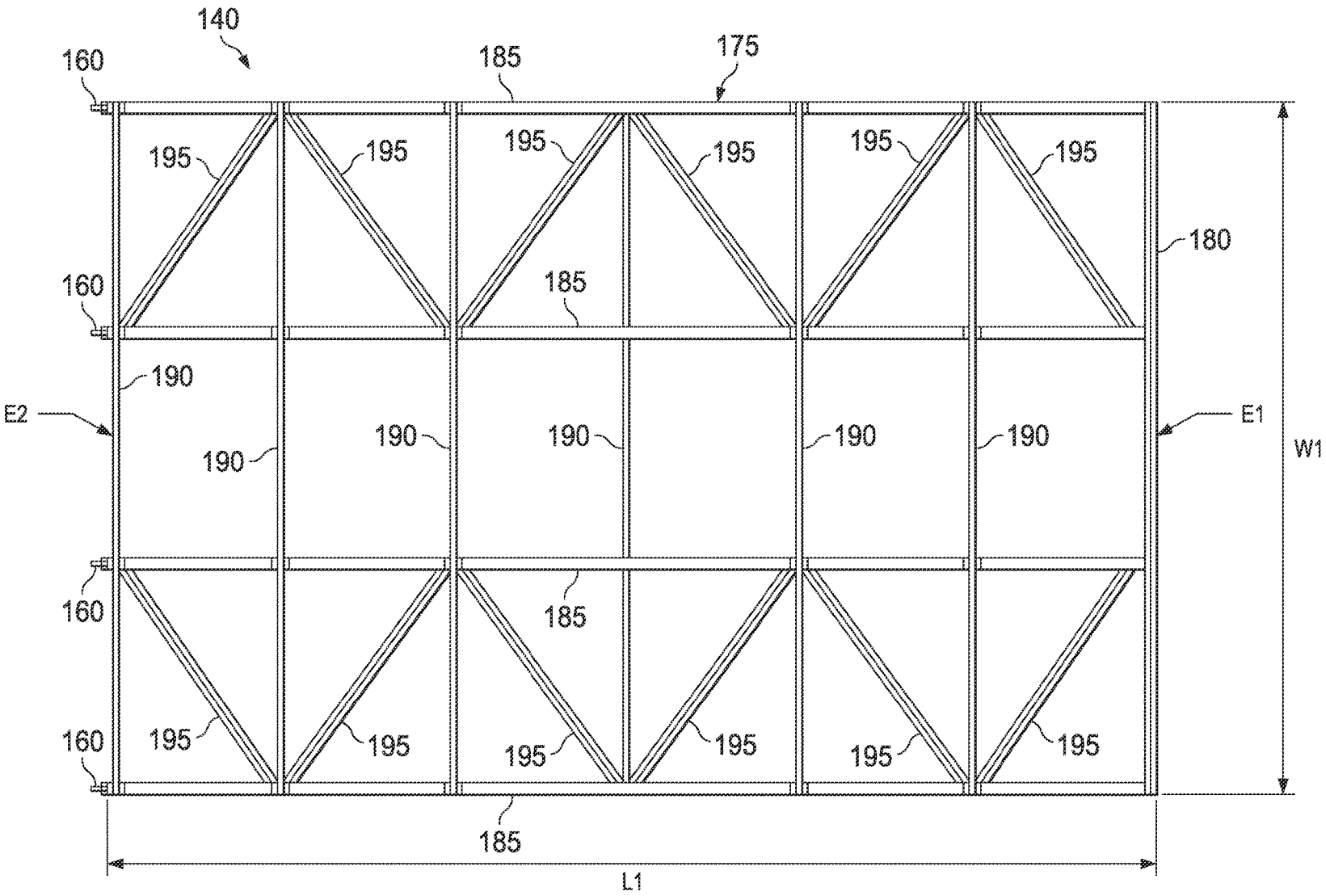
FIG. 3B is a top plan view of the lift table of the lifting apparatus of FIGS. 2A-1 through 2B-4, according to one or more embodiments.
Figure 3C:
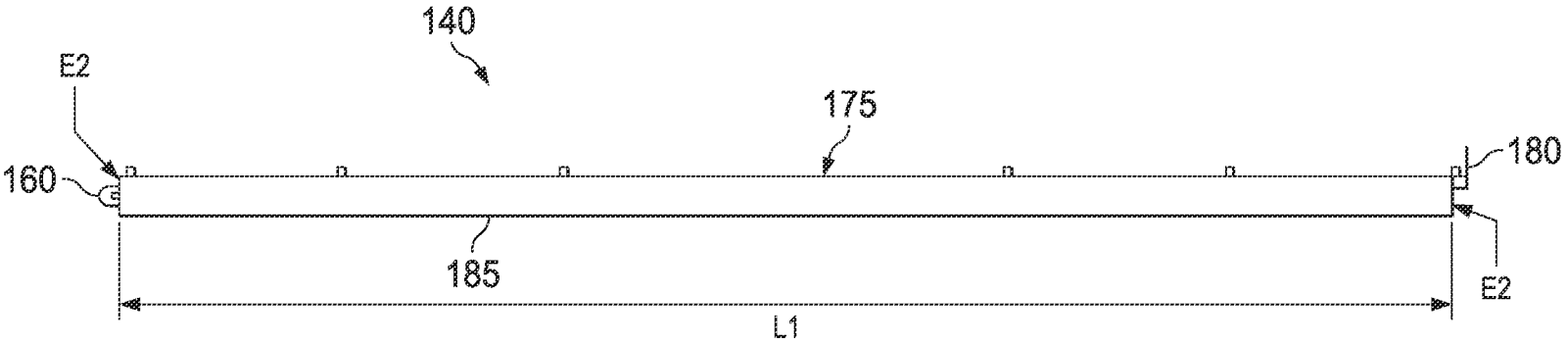
FIG. 3C is an elevational view of the lift table of the lifting apparatus of FIGS. 2A-1 through 2B-4, according to one or more embodiments.

FIGS. 3A through 3C are perspective, top plan, and elevational views, respectively, of the lift table 140 of FIGS. 2A-1 through 2B-4, according to one or more embodiments. In some embodiments, the lift table 140 is or includes structural steel. Referring to FIGS. 3A through 3C, in an embodiment, the lift table 140 includes a lifting frame 175, a nose plate 180, and the pick points 160. The lifting frame 175 is rectangular in shape. The lifting frame 175 includes a plurality of interconnected structural members, such as, for example, interconnected beams, braces, angles, and brackets. More particularly, as shown in FIGS. 3A through 3B, the lifting frame 175 includes lengthwise beams 185 spaced apart in a parallel relation. Although described as including the four (4) lengthwise beams 185, the lifting frame 175 may instead include two (2), three (3), five (5) or more lengthwise structural beams spaced apart in a parallel relation. Further, the lifting frame 175 includes widthwise beams 190 interconnecting the lengthwise beams 185 such that the lifting frame 175 forms the rectangular shape. Further still, the lifting frame 175 includes braces 195 extending in alternating diagonal directions between respective outer pairs of the lengthwise beams 185. The braces 195 provide extra structural support to prevent, or at least reduce, deflection of the lifting frame 175 when successive ones of the wall modules $\mathbf{100}_{1\text{-}N}$ are supported on the lift table 140. In some embodiments, the lifting frame 175 has a widthwise dimension W1 of about 40 feet and a lengthwise dimension L1 of about 60 feet. The nose plate 180 extends (e.g., perpendicularly) along a widthwise edge E1 of the lifting frame 175 and is adapted to support successive ones of the wall modules $\mathbf{100}_{1\text{-}N}$ when the lifting apparatus 130 is in the second configuration, as will be described in further detail below. The pick points 160 are positioned at an opposite widthwise edge E2 of the lifting frame 175. An Appendix forms part of the '268 Applications, which is hereby incorporated herein by reference in its entirety; pages 2 through 41 of the Appendix of the '268 Applications illustrate detailed build plans for the lift table 140 shown in FIGS. 3A through 3C of the drawings.

Figure 4A:
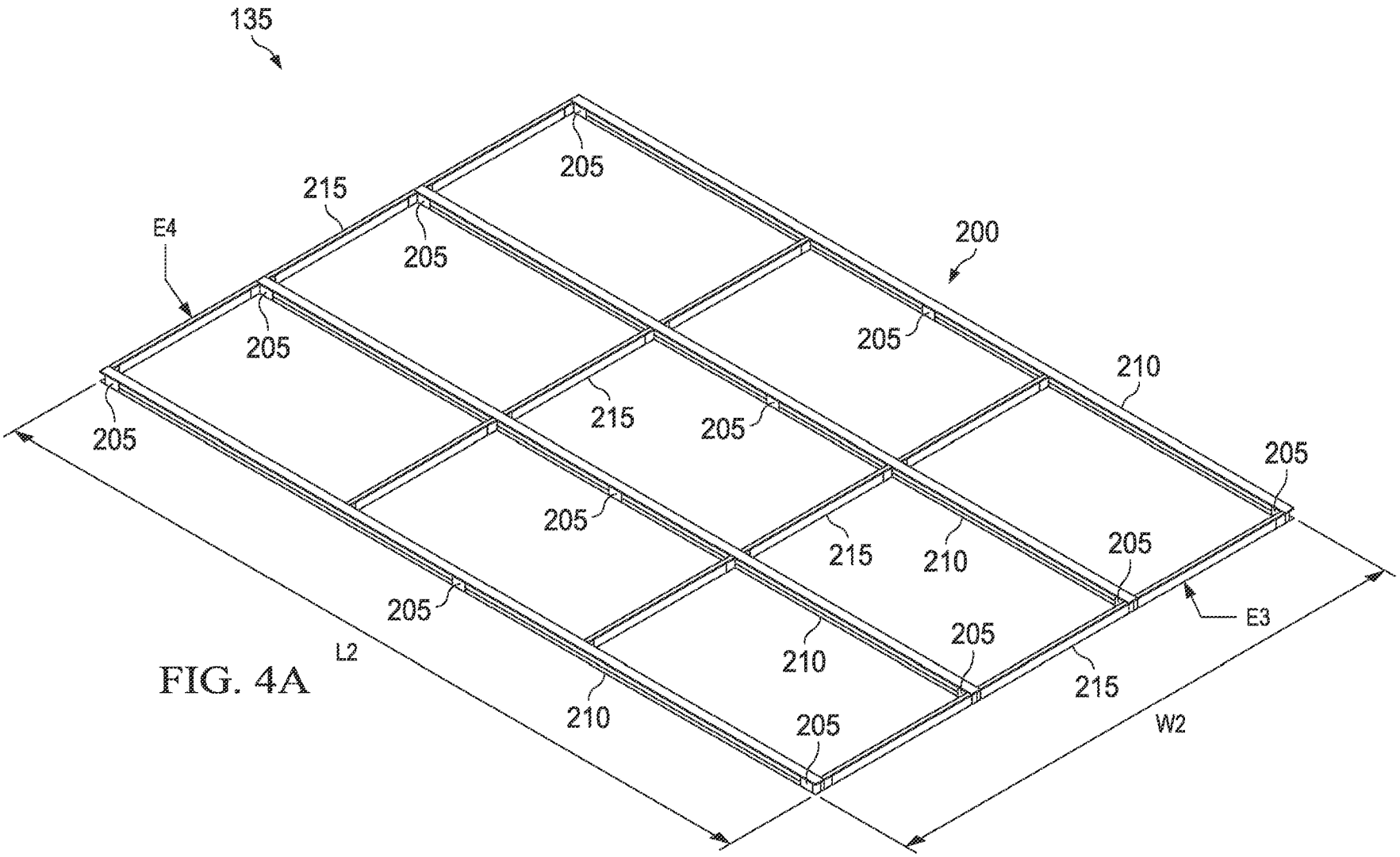
FIG. 4A is a perspective view of a base of the lifting apparatus of FIGS. 2A-1 through 2B-4, according to one or more embodiments.
Figure 4B:
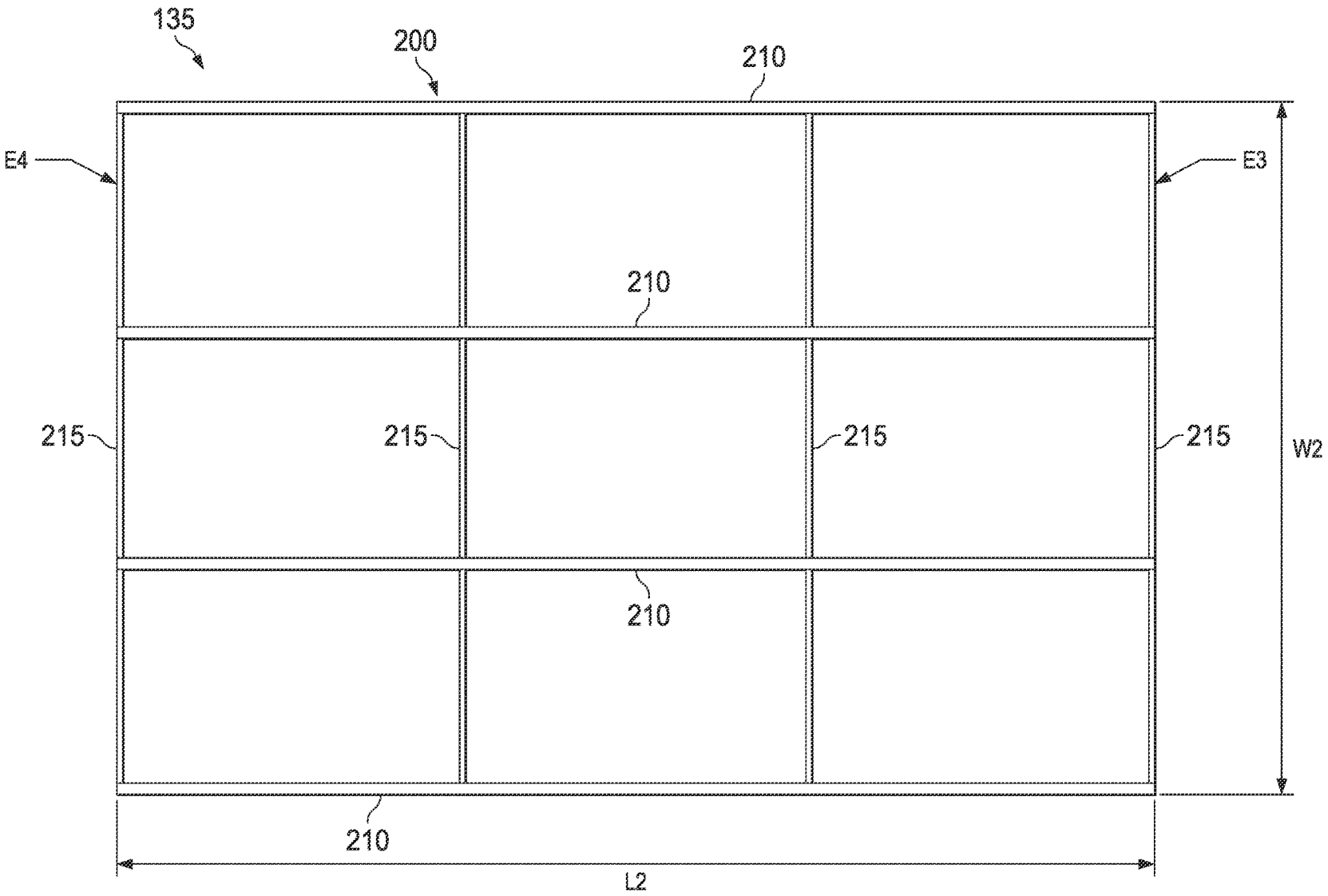
FIG. 4B is a top plan view of the base of the lifting apparatus of FIGS. 2A-1 through 2B-4, according to one or more embodiments.
Figure 4C:
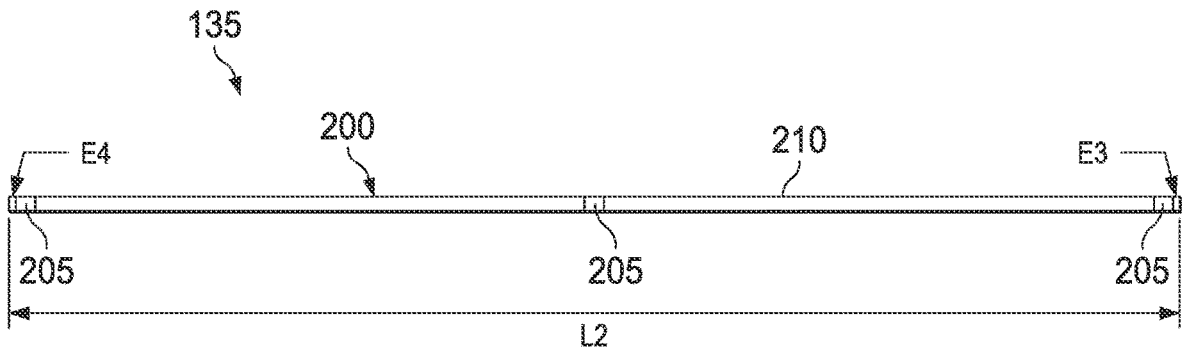
FIG. 4C is an elevational view of the base of the lifting apparatus of FIGS. 2A-1 through 2B-4, according to one or more embodiments.

FIGS. 4A through 4C are perspective, top plan, and elevational views, respectively, of the base 135 of FIGS. 2A-1 through 2B-4, according to one or more embodiments. In some embodiments, the base 135 is or includes structural steel. Referring the FIGS. 4A through 4C, in an embodiment, the base 135 includes a base frame 200 and lifting point stiffener plates 205. The base frame 200 is rectangular in shape. The base frame 200 includes a plurality of interconnected structural members, such as, for example, interconnected beams and brackets. More particularly, as shown in FIGS. 4A through 4B, the base frame 200 includes lengthwise beams 210 spaced apart in a parallel relation. Although described as including the four (4) lengthwise beams 210, the base frame 200 may instead include two (2), three (3), five (5) or more lengthwise structural beams spaced apart in a parallel relation. Further, the base frame 200 includes widthwise beams 215 interconnecting the lengthwise beams 210 such that the base frame 200 forms the rectangular shape. In some embodiments, the base frame 200 has a widthwise dimension W2 of about 40 feet and a lengthwise dimension L2 of about 60 feet. In some embodiments, as in FIGS. 4A through 4C, the lifting point stiffener plates 205 are attached to the lengthwise beams 210 of the base frame 200. For example, the lifting point stiffener plates 205 may be attached to the lifting frame 175 in a grid of twelve (12) different locations. For another example, the lifting point stiffener plates 205 may be attached to the lifting frame 175 in a grid of nine (9) different locations. For yet another example, the lifting point stiffener plates 205 may be attached to the lifting frame 175 in a grid of at least five (5) different locations. Pages 42 through 54 of the Appendix of the '268 Applications illustrate detailed build plans for the base 135 shown in FIGS. 4A through 4C of the drawings.

Each location at which the lifting point stiffener plates 205 are attached to the lifting frame 175 corresponds one of the leveling jacks 150 (shown in FIGS. 2A-1, 2B-1, and 2B-2), which leveling jacks 150 are adapted to be connected to the lifting point stiffener plates 205 to level the base 135 on site. Further, in some embodiments, the counterweights 155 (shown in FIGS. 2A-1, 2B-1, and 2B-2) include two (2) counterweights 155. In some instances, the first counterweight 155 is adapted to be hung from one or more of the lifting point stiffener plates 205 positioned along a widthwise edge E3 of the base frame 200. Moreover, the second counterweight 155 is adapted to be hung from one or more of the lifting point stiffener plates 205 positioned along an opposite widthwise edge E4 of the base frame 200. Detailed build plans for the counterweights 155 are illustrated on pages 62 through 65 of the Appendix of the '268 Application. Finally, in some embodiments, one or more of the lifting point stiffener plates 205, such as the lifting point stiffener plates 205 positioned along the widthwise edge E3 of the base frame 200, may serve as the hinge part 145*b* (shown in FIGS. 2A-1, 2B-1, and 2B-2) of the base 135.

Figure 5:
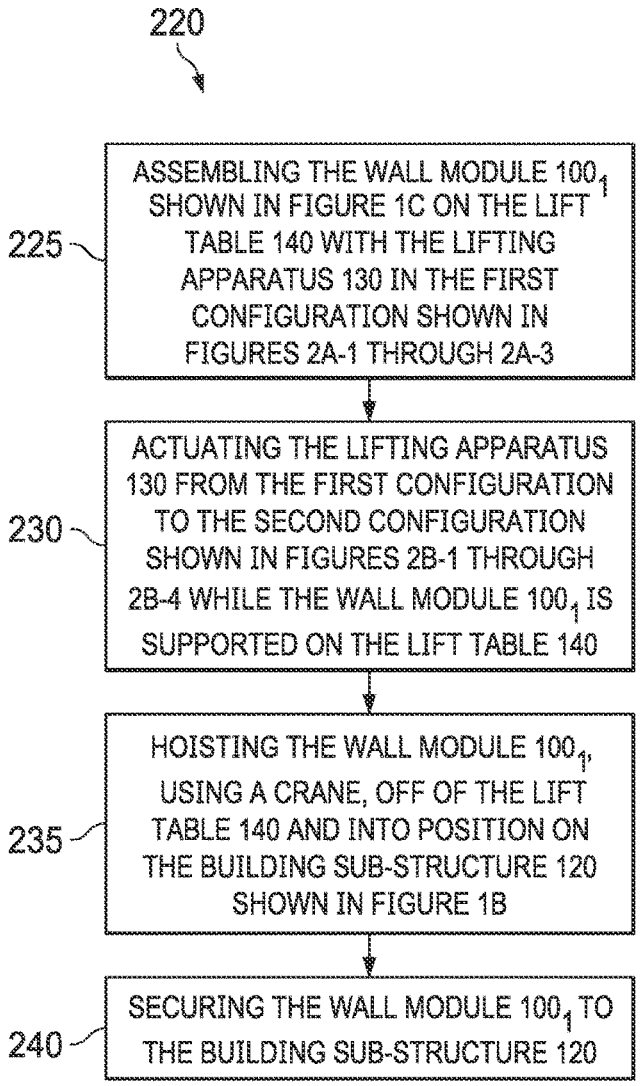
FIG. 5 is a flow diagram of a method for implementing one or more embodiments of the present disclosure.
Figure 6A:
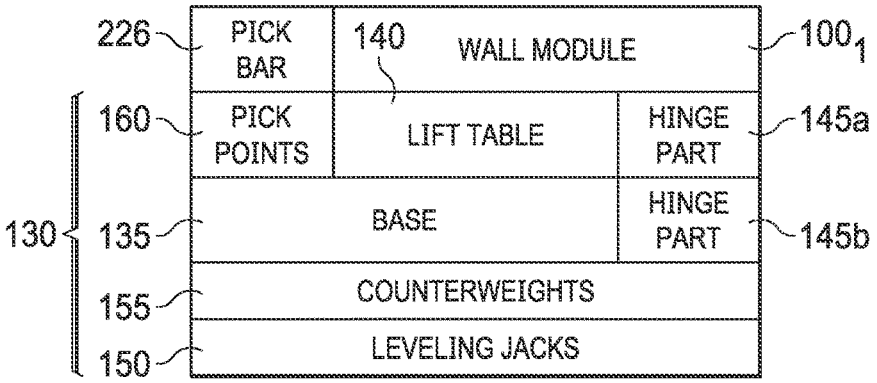
FIG. 6A is a diagrammatic illustration of a system including the lifting apparatus of FIGS. 2A-1 through 2B-4, the system being in a third operational state or configuration during the execution of FIG. 5's method, according to one or more embodiments.

Referring to FIG. 5, a method 220 of installing the wall module $\mathbf{100}_1$ on the building structure 125, that is, the building sub-structure 120, is illustrated according to one or more embodiments. The method 220 includes at a step 225, assembling the wall module $\mathbf{100}_1$ shown in FIG. 1C on the lift table 140 with the lifting apparatus 130 in the first configuration shown in FIGS. 2A-1 through 2A-3. FIG. 6A diagrammatically illustrates the wall module $\mathbf{100}_1$ assembled on the lift table 140 with a pick bar 226 attached to the wall module $\mathbf{100}_1$. Pages 55-58 of the Appendix of the '268 Application illustrate detailed build plans for the pick bar 226. In one or more embodiments, to assemble the wall module $\mathbf{100}_1$ on the lift table 140 at the step 225, the framing sections $\mathbf{105}_{1\text{-}N}$ shown in FIG. 1C are pre-assembled offsite. The framing sections $\mathbf{105}_{1\text{-}N}$ are then interconnected on site to form the wall frame 115 supported on the lift table 140. Finally, the sheeting sections $\mathbf{110}_{1\text{-}N}$ are secured to the wall frame 115 supported on the lift table 140 to complete the wall module $\mathbf{100}_1$.

Figure 6B:
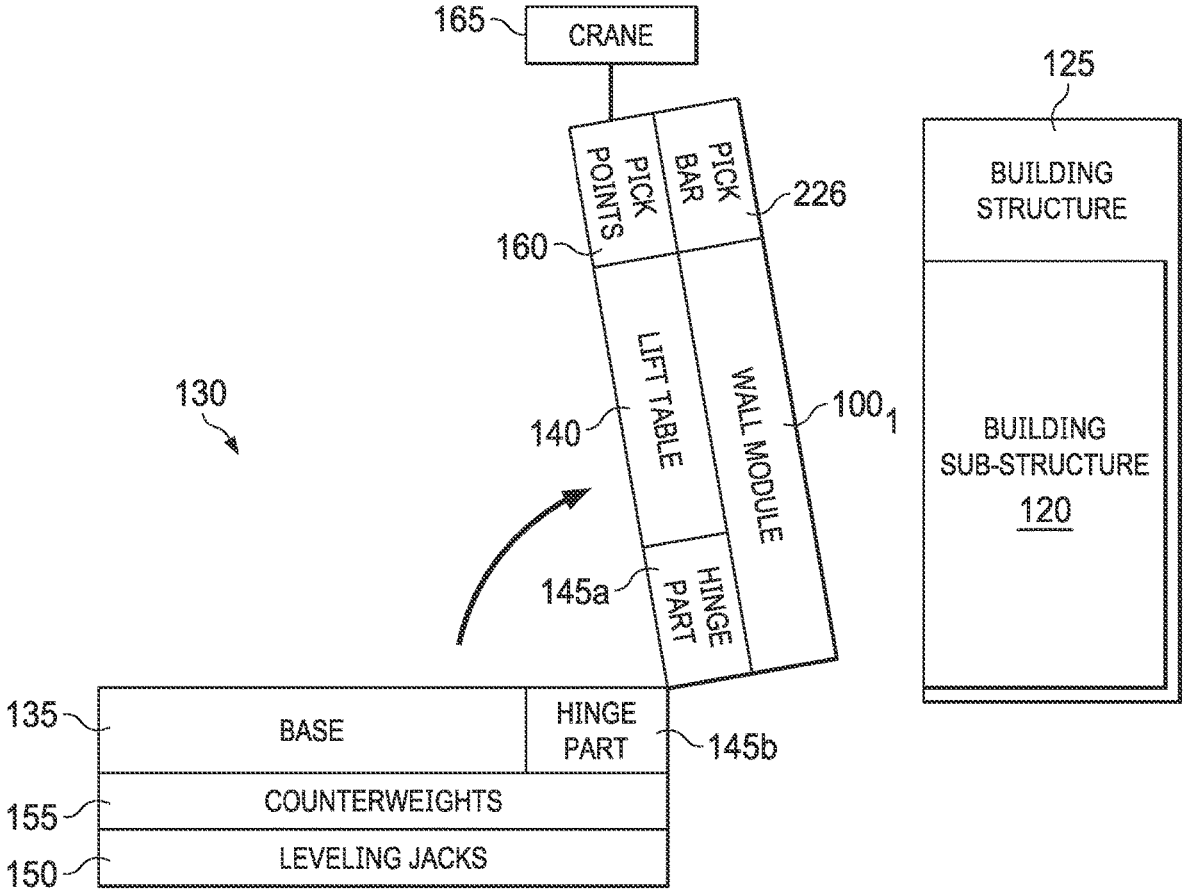
FIG. 6B is a diagrammatic illustration of the system including the lifting apparatus of FIGS. 2A-1 through 2B-4, the system being in a fourth operational state or configuration during the execution of FIG. 5's method, according to one or more embodiments.

At a step 230 of the method 220 shown in FIG. 5, the lifting apparatus 130 is actuated from the first configuration to the second configuration shown in FIGS. 2B-1 through 2B-4 while the wall module $\mathbf{100}_1$ is supported on the lift table 140. FIG. 6B diagrammatically illustrates the crane 165 rigged to the pick points 160 of the lift table 140 to actuate the lifting apparatus 130 from the first configuration to the second configuration, as also shown in FIG. 2B-1. Alternatively, the pick points 160 may be omitted from the lift table 140 in favor of the hydraulic cylinders 170 connected between the lift table 140 and the base 135 to actuate the lifting apparatus 130 from the first configuration to the second configuration, as shown in FIG. 2B-2. At the step 230, the wall module $\mathbf{100}_1$ pivots together with the lift table 140 about the hinge parts 145*a-b* to the second configuration. During this pivoting, the counterweights 155 hold the base 135 and the leveling jacks 150 in position.

Figure 6C:
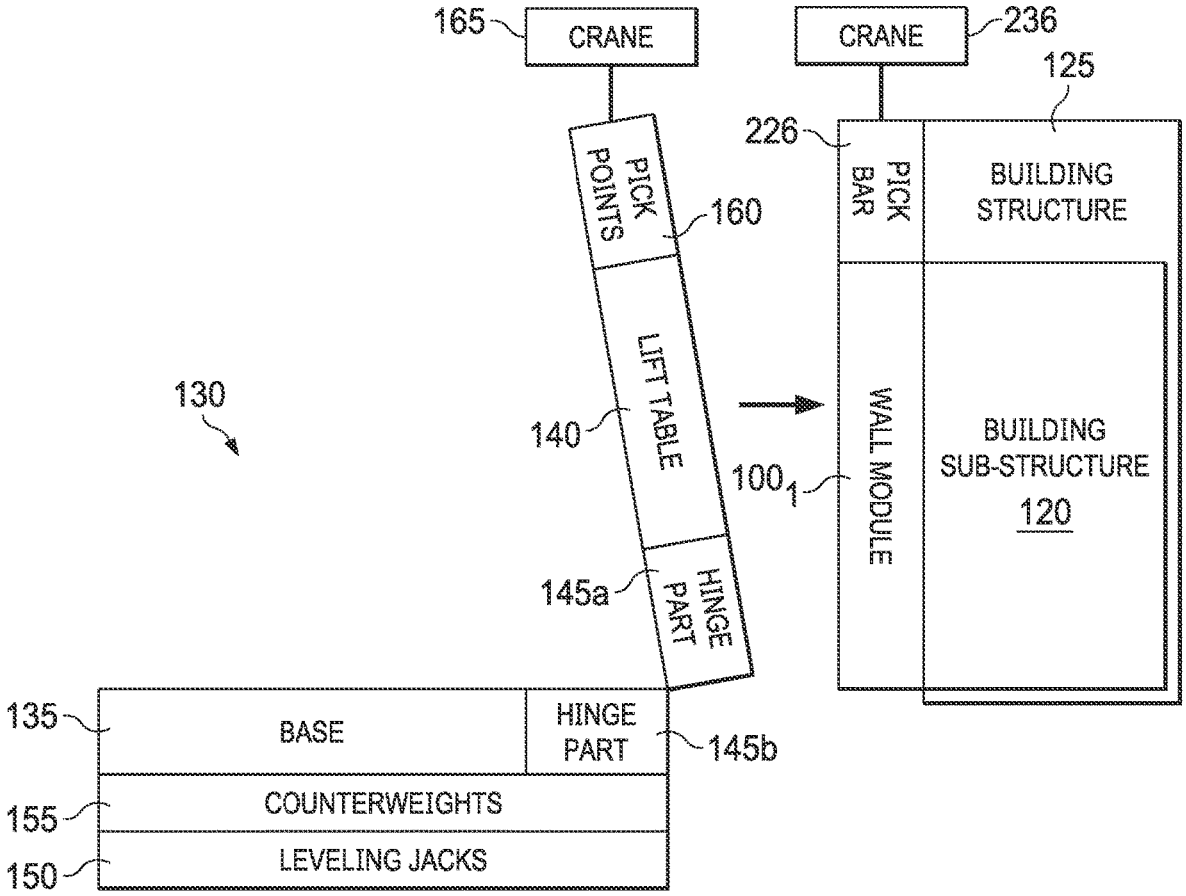
FIG. 6C is a diagrammatic illustration of the system including the lifting apparatus of FIGS. 2A-1 through 2B-4, the system being in a fifth operational state or configuration during the execution of FIG. 5's method, according to one or more embodiments.

At a step 235 of the method 220 shown in FIG. 5, while the lifting apparatus 130 is in the second configuration, the wall module $\mathbf{100}_1$ is hoisted, using a crane 236, off of the lift table 140 and into position on the building sub-structure 120 shown in FIG. 1B. FIG. 6C illustrates the crane 236 hoisting the wall module $\mathbf{100}_1$ into position on the building sub-structure 120 via the pick bar 226 connected to the wall module $\mathbf{100}_1$. Page 61 of the Appendix of the '268 Application illustrates the rigging scheme by which the crane 236 hoists the wall module $\mathbf{100}_1$. In those embodiments in which the crane 165 is used at the step 230 to actuate the lifting apparatus 130 from the first configuration to the second configuration, a different crane, such as the crane 236, may be used to hoist the wall module $\mathbf{100}_1$ off of the lift table 140 and into position on the building sub-structure 120. Alternatively, the lifting apparatus 130 may be locked in the second configuration using a locking mechanism (not shown) and the crane 165 may be re-rigged to the wall module $\mathbf{100}_1$ to hoist the wall module $\mathbf{100}_1$ into position on the building sub-structure 120.

Finally, at a step 240 of the method 220 shown in FIG. 5, the wall module $\mathbf{100}_1$ is secured to the building sub-structure 120. Page 67 of the Appendix of the '268 Application describes and illustrates the manner in which the wall module $\mathbf{100}_1$ is secured to the building sub-structure 120.

Figure 6D:
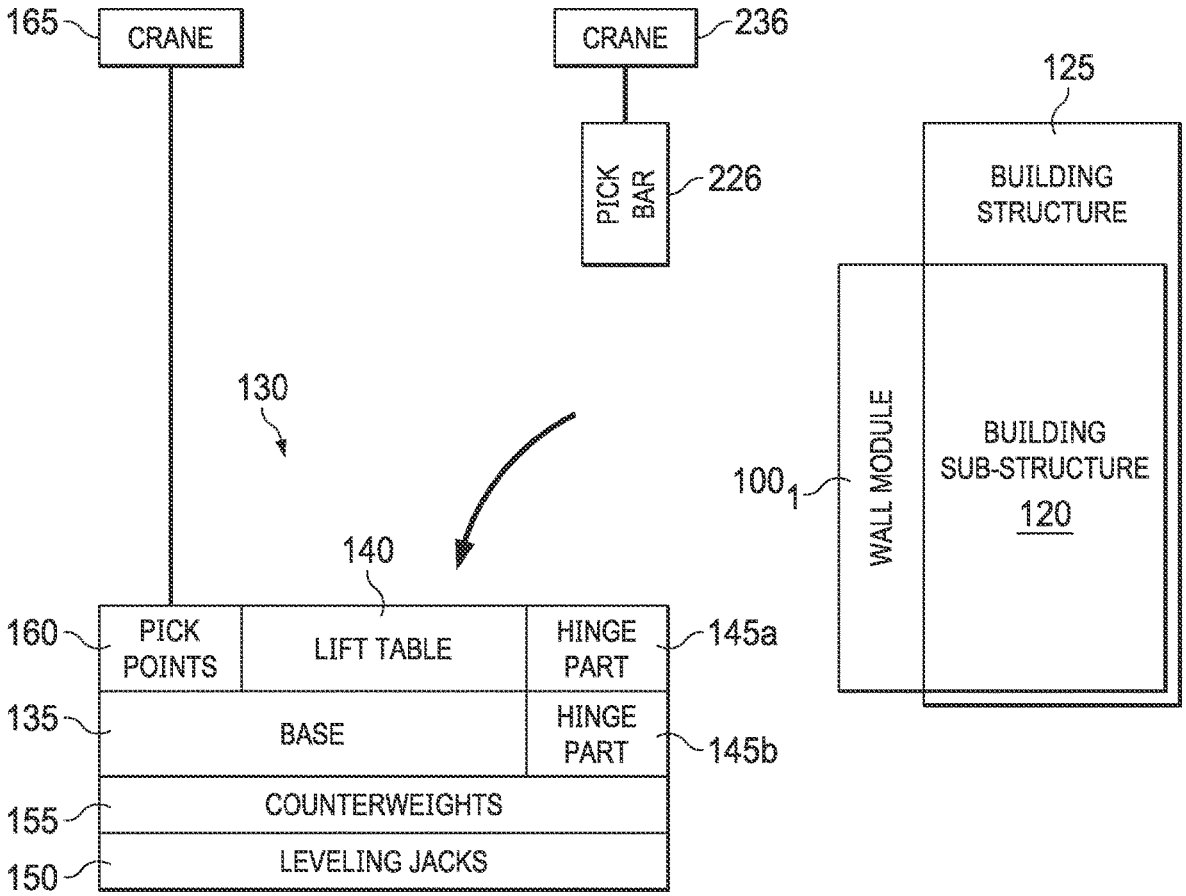
FIG. 6D is a diagrammatic illustration of the system including the lifting apparatus of FIGS. 2A-1 through 2B-4, the system being in a sixth operational state or configuration during the execution of FIG. 5's method, according to one or more embodiments.

Referring to FIG. 6D, after the method 220 has been completed, the pick bar 226 is detached from the wall module $\mathbf{100}_1$ in preparation for installing a next one of the wall modules $\mathbf{100}_{2\text{-}N}$ using the pick bar 226. Moreover, the lift table 140 is lowered back into the first configuration so that the next one of the wall modules $\mathbf{100}_{2\text{-}N}$ may be loaded onto the lift table 140 for installation onto the building sub-structure 120. The manner in which the wall modules $\mathbf{100}_{2\text{-}N}$ are installed onto the building sub-structure 120 is substantially identical to the manner in which the wall module $\mathbf{100}_1$ is installed onto the building sub-structure 120 using the method 220 and, therefore, will not be described in further detail. In some instances, before the next one of the wall modules $\mathbf{100}_{2\text{-}N}$ can be installed onto the building sub-structure 120, the lifting apparatus 130 must be moved to a different position relative to the building structure 125. Pages 59 and 60 of the Appendix of the '268 Application illustrate the rigging scheme by which the crawler crane hoists the lifting apparatus 130 to move the lifting apparatus 130 to a different on-site location. In some embodiments, the counterweights 155 are moved separately from the remainder of the lifting apparatus 130 to the new on-site location. For example, page 66 of the Appendix of the '268 Application illustrates the rigging scheme by which the crawler crane separately hoists each of the counterweights 155 of the lifting apparatus 130 to move the counterweights 155 to the different on-site location.

The lifting apparatus 130 and the method 220 described herein provide a safe, ground-level working platform on which to assemble each wall frame 115, install the sheeting sections $\mathbf{110}_{1\text{-}N}$, and then to transition the completed wall module $\mathbf{100}_1$ from a horizontal orientation to a vertical orientation (e.g., an 80-degree vertical position). Conventionally, to transition a wall section from a horizontal position to a vertical position, rolling blocks have been used to lift the wall section from four (4) points. However, this required attachment points on the face of the wall section, which attachment points would be incompatible with the present wall modules $\mathbf{100}_{1\text{-}N}$. Additionally, the process of lifting and rotating such a wall section to vertical created a bending moment in the structural elements of the wall section, causing a deflection greater than what the connections attaching sheeting to the wall section could tolerate. Both of these challenges are addressed by the lifting apparatus 130 and the method 220 of the present disclosure. More particularly, the lifting apparatus 130 and the method 220 of the present disclosure minimize stresses within each wall module $\mathbf{100}_{1\text{-}N}$ by, for example, limiting the maximum deflection of each wall module $\mathbf{100}_{1\text{-}N}$ to one inch or less. Further, the efficiency of crane rigging is improved by the lifting apparatus 130 and the method 220 of the present disclosure because the wall module $\mathbf{100}_{1\text{-}N}$ are rigged for vertical lifting via the pick bar 226 only once at ground level. Further still, the lifting apparatus 130 and method 220 of the present disclosure protect the facade of the sheeting sections $\mathbf{110}_{1\text{-}N}$ because no rigging is required on or across the face of the wall module $\mathbf{100}_1$. Further still, the lifting apparatus 130 and the method 220 of the present disclosure provide a level working platform (i.e., the lift table 140) at a safe height not requiring fall protection. Finally, the lifting apparatus 130 and the method 220 of the present disclosure accommodate the ground-level construction of the wall modules $\mathbf{100}_{1\text{-}N}$, as previously discussed herein.

Figure 7A:
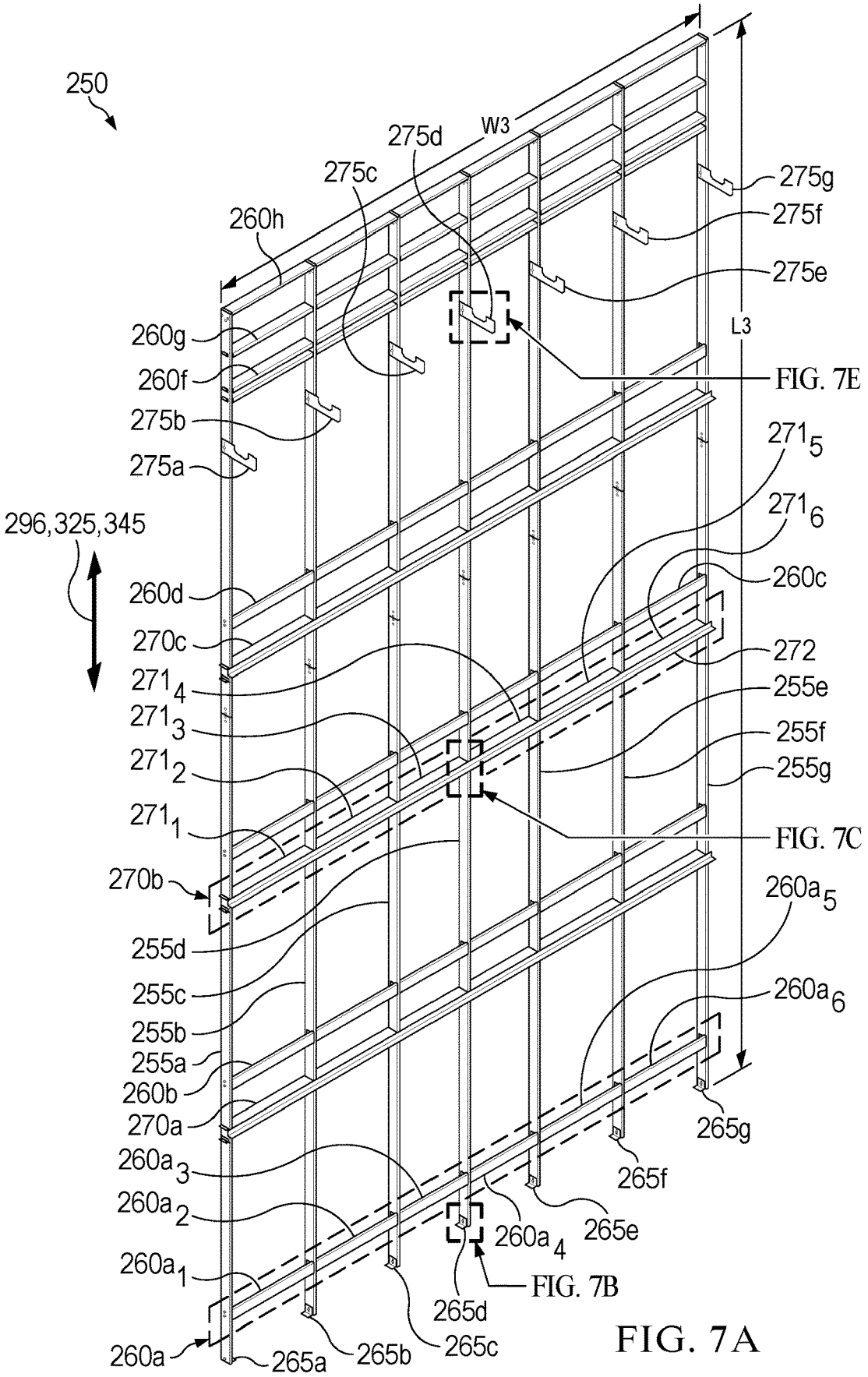
FIG. 7A is a perspective view of a framing section, according to one or more embodiments.

Referring to FIG. 7A, in an embodiment, a framing section is generally referred to by the reference numeral 250, which framing section 250 is generally rectangular in shape. In one or more embodiments, the framing section 250 is, includes, or is part of one or more of the framing sections $\mathbf{105}_{1\text{-}N}$(shown in FIGS. 1A and 1C). The framing section 250 includes a plurality of interconnected beams, angles, and brackets, and may be or include structural steel. More particularly, the framing section 250 includes structural members 255*a-g* (e.g., lengthwise beams) spaced apart in a parallel relation. Although shown and described as including the seven (7) structural members 255*a-g*, the framing section 250 may instead include two (2), three (3), four (4), five (5), six (6), eight (8), or more structural members (e.g., lengthwise beams) spaced apart in a parallel relation. The framing section 250 also includes structural members 260*a-h* (e.g., widthwise beams) interconnecting the structural members 255*a-g* such that the framing section 250 forms the rectangular shape. In one or more embodiments, the structural members 260*a-d* are adapted to extend between a foundation and a roof of the building structure 125, and the structural members 260*e-h* are adapted to extend at or above the roof of the building structure 125. Although shown and described as including the eight (8) structural members 260*a-h*, the framing section 250 may instead include two (2), three (3), four (4), five (5), six (6), seven (7), nine (9), or more structural members (e.g., widthwise beams) interconnecting the structural members 255*a-g*. In some embodiments, the framing section 250 has a widthwise dimension W3 of about 35 feet and a lengthwise dimension L3 of about 60 feet.

The structural members 260*a-h* are substantially identical to one another and, therefore, in connection with FIG. 7A, only the structural member 260*a* will be described in detail below; however, the description below applies equally to the structural members 260*b-h*. As shown in FIG. 7A, in an embodiment, the structural member 260*a* includes beam segments $\mathbf{260}a_{1\text{-}6}$ interconnecting the structural members 255*a-g*. More particularly, the beam segment $\mathbf{260}a_1$ interconnects the structural members 255*a* and 255*b*, the beam segment $\mathbf{260}a_2$ interconnects the structural members 255*b* and 255*c*, the beam segment $\mathbf{260}a_3$ interconnects the structural members 255*c* and 255*d*, the beam segment $\mathbf{260}a_4$ interconnects the structural members 255*d* and 255*e*, the beam segment $\mathbf{260}a_5$ interconnects the structural members 255*e* and 255*f*, and the beam segment $\mathbf{260}a_6$ interconnects the structural members 255*f* and 255*g*.

Referring to FIGS. 7B through 7E, with continuing reference to FIG. 7A, in an embodiment, the framing section 250 also includes couplers 265*a-g* (e.g., bottom couplers), couplers 270*a-c* (e.g., intermediate couplers), and couplers 275*a-g* (e.g., top couplers) for connecting the framing section 250 to the foundation, floors, and roof, respectively, of the building structure 125 (shown in FIGS. 1A, 1B, 6B, 6C, and 6D).

Figure 7B:
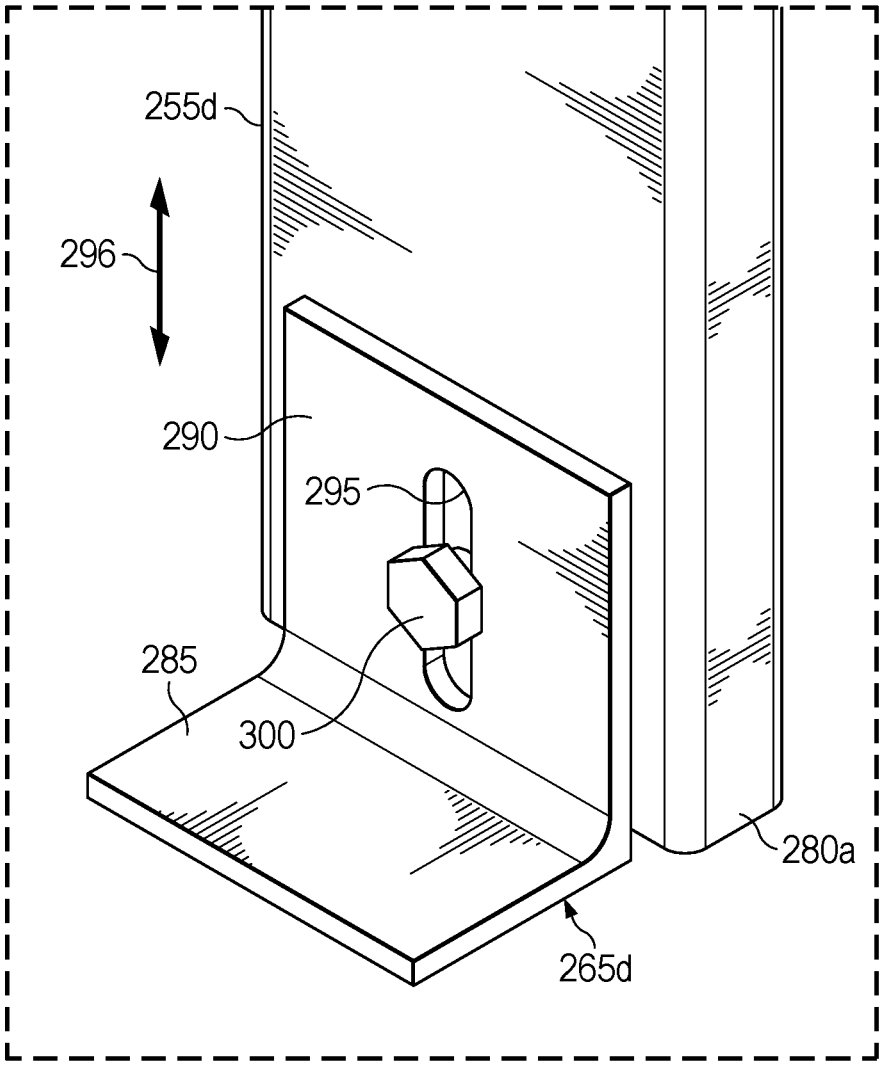
FIG. 7B is an enlarged perspective view of a portion of the framing section of FIG. 7A, according to one or more embodiments.

The couplers 265*a-g* (which may also be referred to as "feet") are connected to the structural members 255*a-g*, respectively, and are substantially identical to one another; therefore, in connection with FIG. 7B, only the coupler 265*d* will be described in detail below; however, the description below applies equally to the couplers 265*a*, 265*b*, 265*c*, 265*e*, 265*f*, and 265*g*. As shown in FIG. 7B, in an embodiment, the coupler 265*d* is connected to an end portion 280*a* of the structural member 255*d*, and includes a base 285 (e.g., a base plate) and a support member 290 (e.g., a support plate). The base 285 and the support member 290 may extend in a perpendicular relation; for example, in one or more embodiments, the coupler 265*d* is an angle. The base 285 is adapted to be connected to the foundation of the building structure 125 so that movement of the structural member 255*d* in a direction 296 and relative to the coupler

265*d* (and thus relative the foundation of the building structure 125) is permitted. A slot 295 is formed through the support member 290, which slot 295 is elongated in the direction 296. In one or more embodiments, the direction 296 is parallel to the structural member 255*d* and perpendicular to the base 285. A fastener 300 extends through the slot 295 and into a hole (not visible in FIG. 7B) formed in the end portion 280*a* of the structural member 255*d*; as a result, the fastener 300 connects the coupler 265*d* to the structural member 255*d*, and relative movement is permitted between the coupler 265*d* and the structural member 255*d* along the slot 295 (i.e., in the direction 296).

In an alternative embodiment, the slot 295 is formed through the end portion 280*a* of the structural member 255*d* instead of the coupler 265*d*, and the hole (not visible in FIG. 7B) is formed in the coupler 265*d* instead of the end portion 280*a* of the structural member 255*d*. In another alternative embodiment, the slot 295 is formed through both the end portion 280*a* of the structural member 255*d* and the coupler 265*d*, and the hole is omitted. In yet another alternative embodiment, the slot 295 and the hole are both omitted and replaced with another suitable mechanism to connect the coupler 265*d* to the end portion 280*a* of the structural member 255*d* while permitting relative movement between the coupler 265*d* and the structural member 255*d* in the direction 296.

Turning briefly back to FIG. 7A, in operation, the couplers 265*a-g* are adapted to be connected to the building structure 125 (e.g., to the foundation of the building structure 125) so that movement of the structural members 255*a-g* (and thus the entire framing section 250) in the direction 296 and relative to the couplers 265*a-g* (and thus relative the building structure 125) is permitted. For example, one or more of the couplers 265*a-g* may be movably connected (via, for example, the slot 295) to the structural members 255*a-g*, respectively, and fixedly connected to the building structure 125 (e.g., via welding, fasteners, embedding in the foundation of the building structure, etc.). For another example, one or more of the couplers 265*a-g* may be fixedly connected to the structural members 255*a-g*, respectively (via welding, fasteners, etc.), and movably connected (via, for example, the slot 295) to the building structure 125. For yet another example, one or more of the couplers 265*a-g* may be movably connected to the structural members 255*a-g*, respectively, and movably connected to the building structure 125.

Figure 7C:
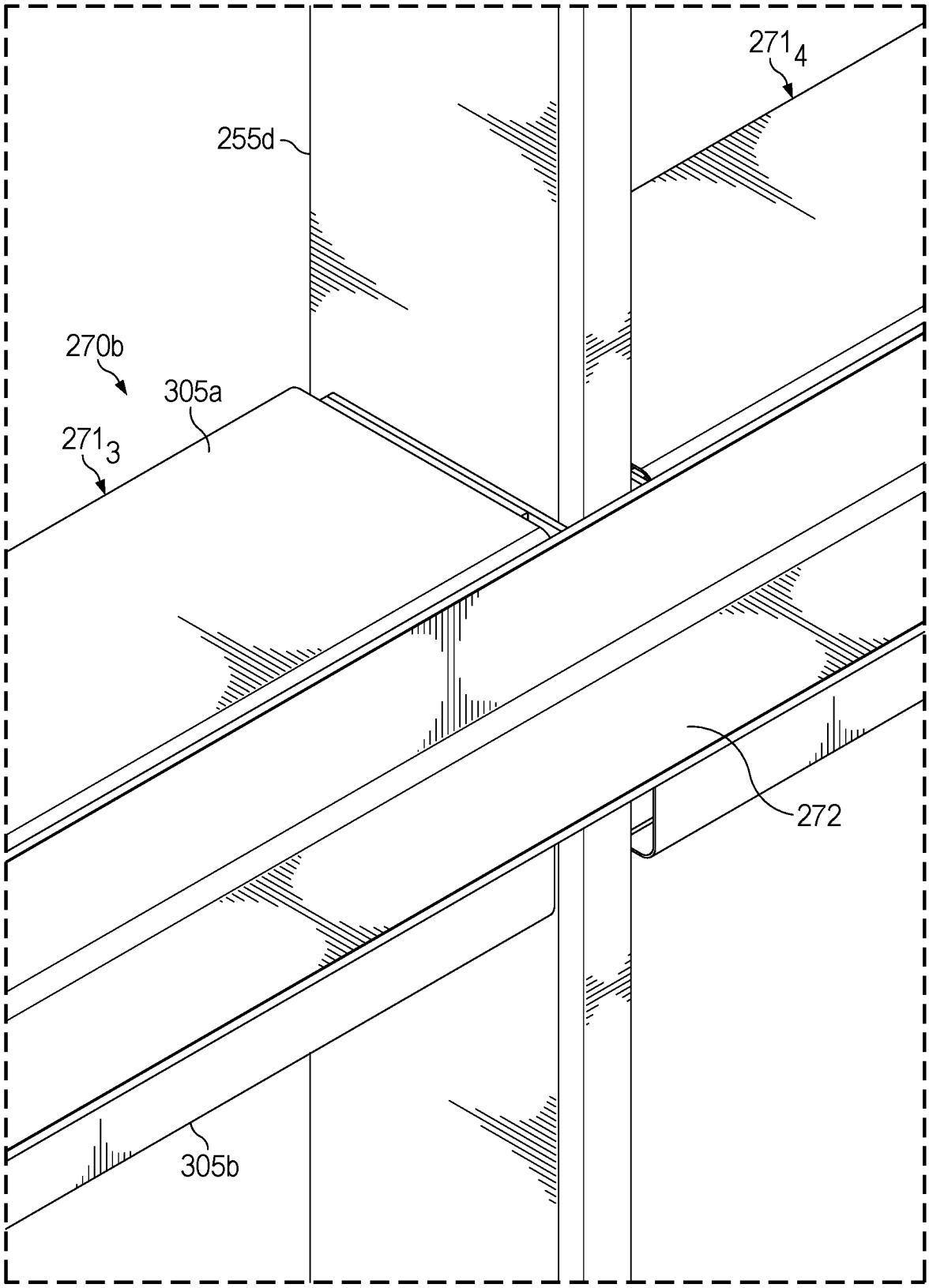
FIG. 7C is an enlarged perspective view of another portion of the framing section of FIG. 7A, according to one or more embodiments.
Figure 7D:
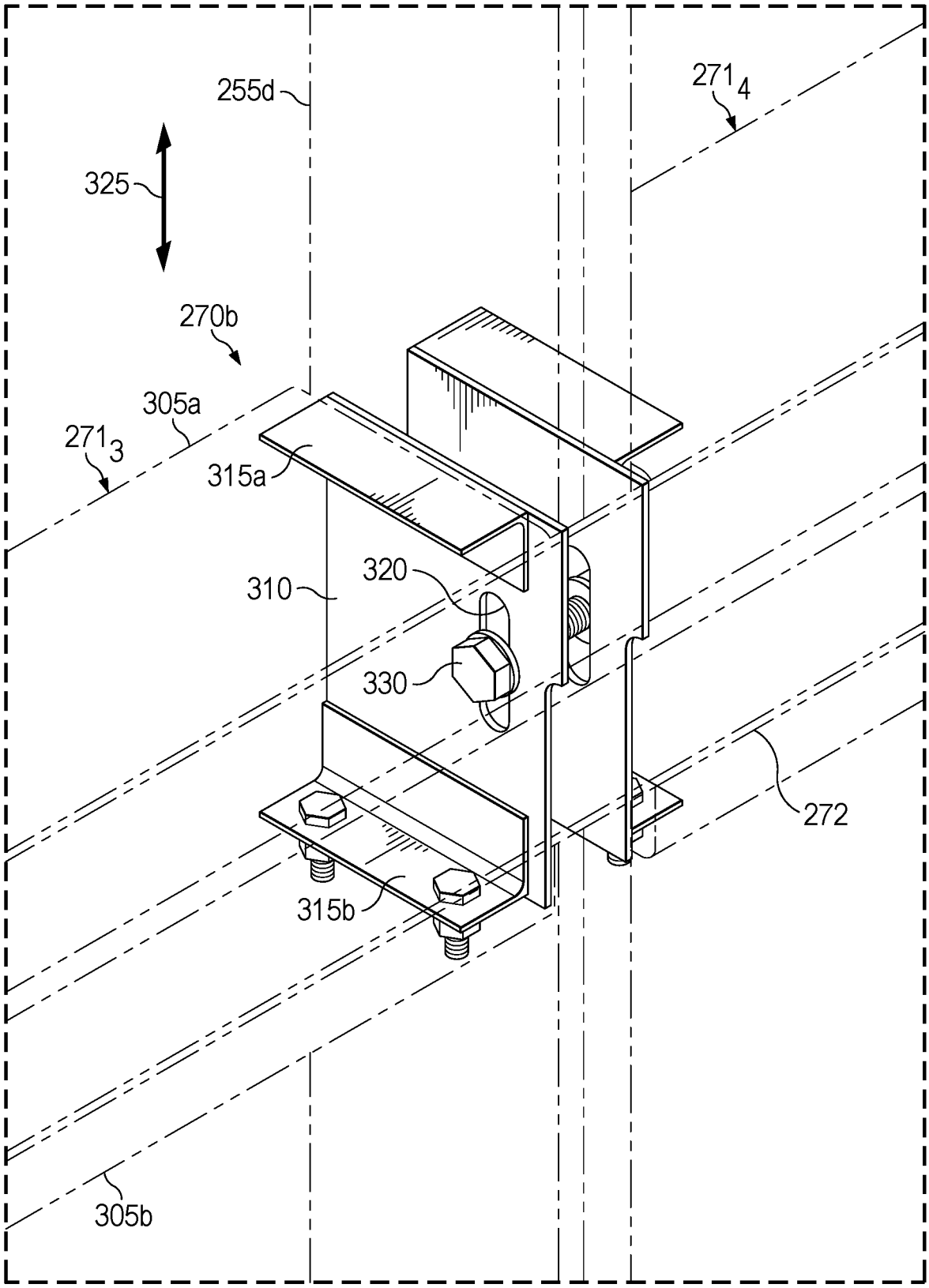
FIG. 7D is an enlarged perspective view similar to FIG. 7C, except that certain feature(s)/component(s) of the another portion of the framing section are rendered transparently, according to one or more embodiments.

The couplers 270*a-c* (which may also be referred to as "floor couplers") interconnect the structural members 255*a-g*, and are substantially identical to one another; therefore, in connection with FIGS. 7A, 7C, and 7D, only the coupler 270*b* will be described in detail below; however, the description below applies equally to the couplers 270*a* and 270*c*. As shown in FIG. 7A, in an embodiment, the coupler 270*b* includes support segments $\mathbf{271}_{1\text{-}6}$ interconnecting the structural members 255*a-g* and a coupler body 272 connected to the support segments $\mathbf{271}_{1\text{-}6}$. More particularly, the support segment $\mathbf{271}_1$ interconnects the structural members 255*a* and 255*b*, the support segment $\mathbf{271}_2$ interconnects the structural members 255*b* and 255*c*, the support segment $\mathbf{271}_3$ interconnects the structural members 255*c* and 255*d*, the support segment $\mathbf{271}_4$ interconnects the structural members 255*d* and 255*e*, the support segment $\mathbf{271}_5$ interconnects the structural members 255*e* and 255*f*, and the support segment $\mathbf{271}_6$ interconnects the structural members 255*f* and 255*g*. Although shown and described as including the six (6) support segments $\mathbf{271}_{1\text{-}6}$, the coupler 270*b* may instead include one (1), two (2), three (3), four (4), five (5), seven (7), or more support segments, provided that the total number of support segments is one (1) less than the total number of structural members 255; for example, in FIG. 7A, the framing section 250 includes the seven (7) structural members 255*a-g* and the coupler 270*b* includes the six (6) support segments $\mathbf{271}_{1\text{-}6}$. In one or more embodiments, the coupler body 272 is an angle.

The support segments $\mathbf{271}_{1\text{-}6}$ are substantially identical to one another; therefore, in connection with FIGS. 7C and 7D, only the support segment $\mathbf{271}_3$ will be described in detail below; however, the description below applies equally to the support segments $\mathbf{271}_1$, $\mathbf{271}_2$, $\mathbf{271}_4$, $\mathbf{271}_5$, and $\mathbf{271}_6$. As shown in FIGS. 7C and 7D, in an embodiment, the support segment $\mathbf{271}_3$ includes a support beam 305*a* to which the coupler body 272 is connected, and a support beam 305*b* spaced in a parallel relation with the support beam 305*a*. The coupler body 272 is also connected to the support segment $\mathbf{271}_4$, straddling the structural member 255*d*. As shown in FIG. 7D, the support beams 305*a* and 305*b* are connected to a support member 310 (e.g., a support plate) using, for example, angles 315*a* and 315*b*, respectively. A slot 320 is formed through the support member 310, which slot 320 is elongated in a direction 325. In one or more embodiments, the direction 325 is parallel to the structural member 255*d*. In addition, or instead, the direction 325 may be the same as the direction 296 when the couplers 265*a-g* and the coupler 270*b* are connected to the building structure 125. A fastener 330 extends through the slot 320 and into a hole (not visible in FIG. 7D) formed in the structural member 255*d*; as a result, the fastener 330 connects the support segment $\mathbf{271}_4$ to the structural member 255*d*, and relative movement is permitted between the support segment $\mathbf{271}_4$ and the structural member 255*d* along the slot 320 (i.e., in the direction 325).

In an alternative embodiment, the slot 320 is formed through the structural member 255*d* instead of the support member 310, and the hole (not visible in FIG. 7B) is formed in the support member 310 instead of the structural member 255*d*. In another alternative embodiment, the slot 320 is formed through both the structural member 255*d* and the support member 310, and the hole is omitted. In yet another alternative embodiment, the slot 320 and the hole are both omitted and replaced with another suitable mechanism to connect the support segment $\mathbf{271}_4$ to the structural member 255*d* while permitting relative movement between the support segment $\mathbf{271}_4$ and the structural member 255*d* in the direction 325. Although not visible in FIGS. 7C and 7D, the manner in which the support segment $\mathbf{271}_4$ is connected to the structural member 255*c* mirrors the manner in which the support segment $\mathbf{271}_4$ is connected to the structural member 255*d* and, therefore, will not be described in further detail.

Turning briefly back again to FIG. 7A, in operation, the respective couplers 270*a-c* are adapted to be connected to the building structure 125 (e.g., to respective floors of the building structure 125) so that movement of the structural members 255*a-g* (and thus the entire framing section 250) in the direction 325 and relative to the couplers 270*a-c* (and thus relative to the building structure 125) is permitted. For example, the support segments $\mathbf{271}_{1\text{-}6}$ of one or more of the couplers 270*a-c* may be movably connected (via, for example, the slot 320) to, and interposed between, the structural members 255*a-g*, respectively, while the coupler body 272 of the one or more of the couplers 270*a-c* is fixedly connected to the building structure 125 (e.g., via welding, fasteners, embedding in the concrete of one of the floors of the building structure 125, etc.). For another example, the support segments $\mathbf{271}_{1\text{-}6}$ of one or more of the couplers

270*a-c* may be fixedly connected to, and interposed between, the structural members 255*a-g*, respectively (e.g., via welding, fasteners, etc.), while the coupler body 272 of the one or more of the couplers 270*a-c* is movably connected (via, for example, the slot 320) to the building structure 125. For yet another example, the support segments $\mathbf{271}_{1\text{-}6}$ of one or more of the couplers 270*a-c* may be movably connected to, and interposed between, the structural members 255*a-g*, respectively, while the coupler body 272 of the one or more of the couplers 270*a-c* is movably connected to the building structure 125.

Figure 7E:
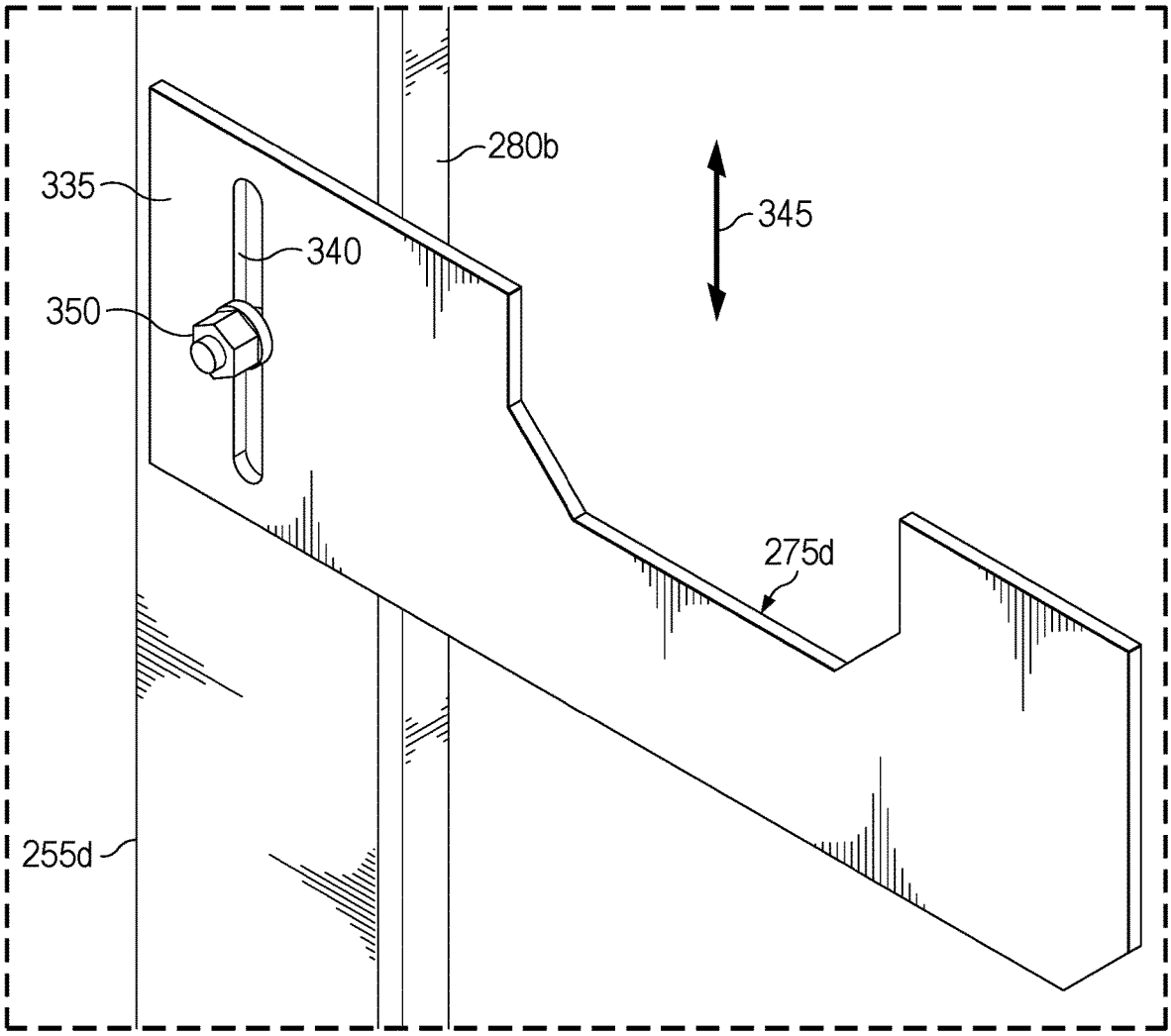
FIG. 7E is an enlarged perspective view of yet another portion of the framing section of FIG. 7A, according to one or more embodiments.

The couplers 275*a-g* (which may also be referred to as "roof couplers") are connected to the structural members 255*a-g*, respectively, and are substantially identical to one another; therefore, in connection with FIG. 7E, only the coupler 275*d* will be described in detail below; however, the description below applies equally to the couplers 275*a*, 275*b*, 275*c*, 275*e*, 275*f*, and 275*g*. As shown in FIG. 7E, in an embodiment, the coupler 275*d* is connected to an end portion 280*b* of the structural member 255*d*, which end portion 280*b* is opposite the end portion 280*a* (labelled in FIG. 7B). The coupler 275*d* includes a support member 335 (e.g., a support plate), which support member 335 is adapted to be connected to the roof of the building structure 125 so that movement of the structural member 255*d* in a direction 345 and relative to the coupler 275*d* (and thus relative the roof of the building structure 125) is permitted. A slot 340 is formed through the support member 335, which slot 340 is elongated in the direction 345. In one or more embodiments, the direction 345 is parallel to the structural member 255*d*. In addition, or instead, the direction 345 may be the same as: the direction 296 when the couplers 265*a-g* and the couplers 275*a-g* are connected to the building structure 125; the direction 325 when the couplers 270*a-c* and the couplers 275*a-g* are connected to the building structure 125; or both. A fastener 350 extends through the slot 340 and into a hole (not visible in FIG. 7E) formed in the end portion 280*b* of the structural member 255*d*; as a result, the fastener 350 connects the coupler 275*d* to the structural member 255*d*, and relative movement is permitted between the coupler 275*d* and the structural member 255*d* along the slot 340 (i.e., in the direction 345).

In an alternative embodiment, the slot 340 is formed through the end portion 280*b* of the structural member 255*d* instead of the coupler 275*d*, and the hole (not visible in FIG. 7E) is formed in the coupler 275*d* instead of the end portion 280*b* of the structural member 255*d*. In another alternative embodiment, the slot 340 is formed through both the end portion 280*b* of the structural member 255*d* and the coupler 275*d*, and the hole is omitted. In yet another alternative embodiment, the slot 340 and the hole are both omitted and replaced with another suitable mechanism to connect the coupler 275*d* to the end portion 280*b* of the structural member 255*d* while permitting relative movement between the coupler 275*d* and the structural member 255*d* in the direction 345.

Turning back again to FIG. 7A, in operation, the couplers 275*a-g* are adapted to be connected to the building structure 125 (e.g., to the roof of the building structure 125) so that movement of the structural members 255*a-g* (and thus the entire framing section 250) in the direction 345 and relative to the couplers 275*a-g* (and thus relative the building structure 125) is permitted. For example, one or more of the couplers 275*a-g* may be movably connected (via, for example, the slot 340) to the structural members 255*a-g*, respectively, and fixedly connected to the building structure 125 (e.g., via welding, fasteners, another fixed connection to a roof portion of the building structure 125, etc.). For another example, one or more of the couplers 275*a-g* may be fixedly connected to the structural members 255*a-g*, respectively (via welding, fasteners, etc.), and movably connected (via, for example, the slot 340) to the building structure 125. For yet another example, one or more of the couplers 275*a-g* may be movably connected to the structural members 255*a-g*, respectively, and movably connected to the building structure 125.

Figure 8A:
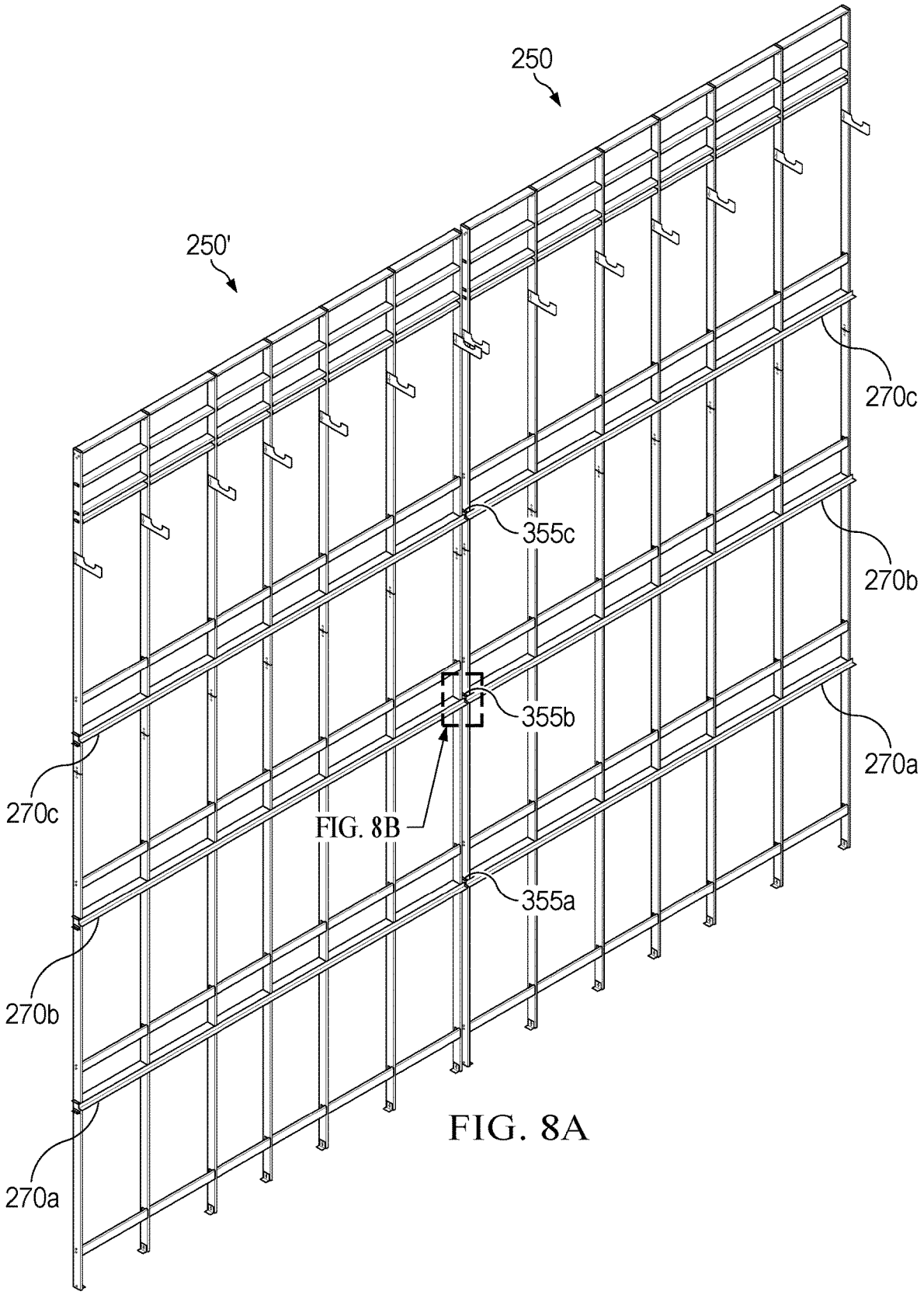
FIG. 8A is a perspective view of a wall frame including the framing section of FIG. 7A connected to another framing section, according to one or more embodiments.
Figure 8B:
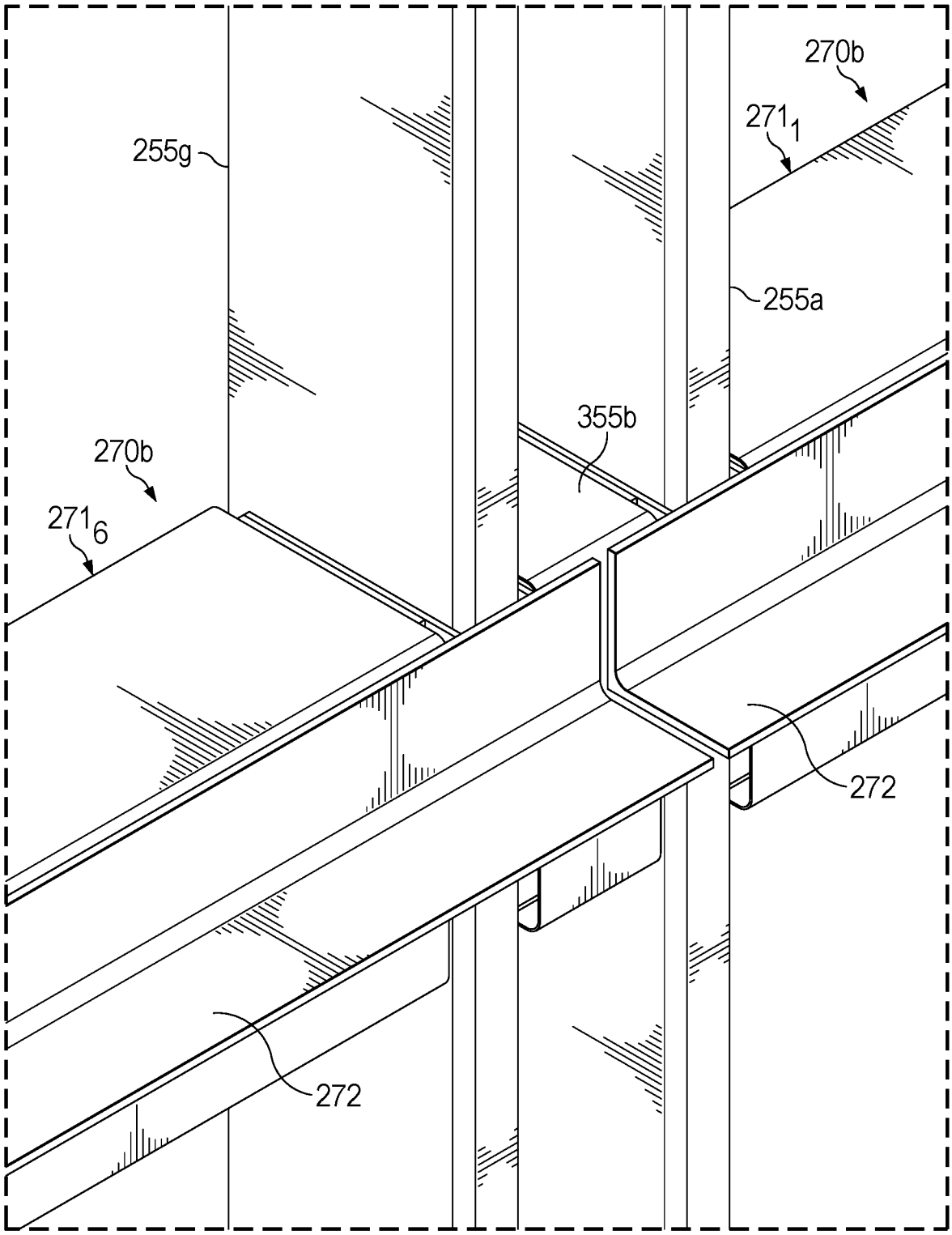
FIG. 8B is an enlarged perspective view of a portion of the wall frame of FIG. 8A, according to one or more embodiments.
Figure 8C:
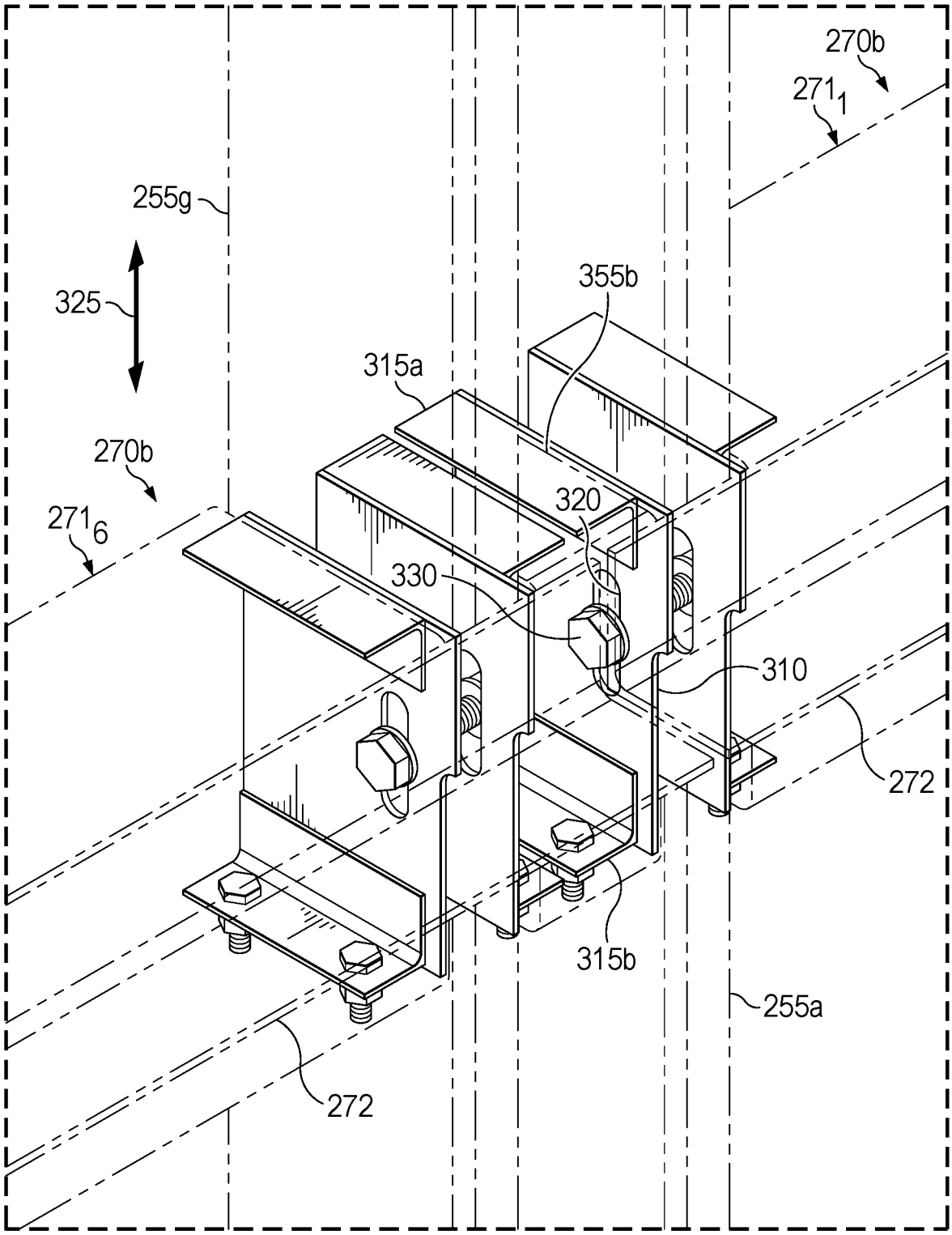
FIG. 8C is an enlarged perspective view similar to FIG. 8B, except that certain feature(s)/component(s) of the portion of the wall frame are rendered transparently, according to one or more embodiments.

Referring to FIGS. 8A through 8C, in an embodiment, another framing section 250' is connected to the framing section 250. In one or more embodiments, the framing section 250' is, includes, or is part of, one or more of the framing sections $\mathbf{105}_{1\text{-}N}$(shown in FIGS. 1A and 1C). As shown in FIG. 8A, the framing section 250' includes feature(s)/component(s) substantially identical to corresponding feature(s)/component(s) of the framing section 250, which substantially identical feature(s)/component(s) are given the same reference numerals.

Support segments 355*a-c* connect the framing section 250' to the framing section 250'. More particularly, the support segments 355*a-c* are connected to the couplers 270*a-c*, respectively, of the framing sections 250 and 250', and include feature(s)/component(s) substantially similar to corresponding feature(s)/component(s) of the support segments $\mathbf{271}_{1\text{-}6}$ (shown in FIG. 7A), which substantially similar feature(s)/component(s) are given the same reference numerals. The support segment 355*a-c* are substantially identical to one another; therefore, in connection with FIGS. 8B and 8C, only the support segment 355*b* will be described in detail below; however, the description of the support segment 355*b* below applies equally to the support segments 355*a* and 355*c*. The support segment 355*b* extends between, and is movably connected to, the structural member 255*a* of the framing section 250 and the structural member 255*g* of the framing section 250'. The coupler body 272 of the coupler 270*b* of the framing section 250 is connected to the support segment 355*b*. Likewise, the coupler body 272 of the coupler 270*b* of the framing section 250' is connected to the support segment 355*b*. As a result, the support segment $\mathbf{271}_1$ of the framing section 250, the support segment $\mathbf{271}_6$ of the framing section 250', and the support segment 355*b* are interconnected and together movable relative to the structural members 255*a-g* of the framing sections 250 and 250'. Accordingly, the coupler 270*b* of the framing section 250, the coupler 270*b* of the framing section 250', and the support segment 355*b* may together be referred to as a "coupler."

In one or more embodiments, the "couplers" described herein permit "flexing" of the building structure 125 (e.g., from temperature changes, seismic activity, etc.) while preventing, or at least reducing, any corresponding deformation of the framing sections 250 and 250'. Moreover, any of the wall modules $\mathbf{100}_{1\text{-}N}$ including the framing section 250 (and/or the framing section 250') are allowed to "float" relative to the building structure 125; this "floating" permits the wall modules $\mathbf{100}_{1\text{-}N}$ to rest on the foundation of the building structure 125, rather than being carried by the building structure 125, thereby reducing wear and fatigue on the building structure 125.

In some embodiments, one or more of the embodiments of the present application are provided in whole or in part as described and illustrated in the Appendix of the '268 Application, which forms part of the present application.

In some embodiments, one or more of the embodiments described and illustrated in the Appendix of the '268 Application are combined in whole or in part with one or more of the embodiments described above and/or one or more of the other embodiments described and illustrated in the Appendix.

A system has been disclosed. The system generally includes: a building structure; and a framing section connected to the building structure, the framing section including: a plurality of structural members; and a first coupler connected to a first structural member of the plurality of structural members; wherein the first coupler permits relative movement between the framing section and the building structure in a first direction. In one or more embodiments, the first coupler includes: a support plate; and a fastener; the fastener extends through an elongated slot to movably connect the support plate to the first structural member; and the elongated slot is formed in the support plate, the first structural member, or both. In one or more embodiments, the system further includes: a plurality of sheeting sections connected to the framing section on a side of the framing section opposite the building structure. In one or more embodiments: (i) the first coupler is movably connected to the first structural member; and the first coupler is fixedly connected to the building structure; (ii) the first coupler is fixedly connected to the first structural member; and the first coupler is movably connected to the building structure; or (iii) the first coupler is movably connected to the first structural member; and the first coupler is movably connected to the building structure. In one or more embodiments, the framing section further includes a second coupler; and the second coupler permits relative movement between the framing section and the building structure in a second direction, which second direction is the same as the first direction. In one or more embodiments: (iv) the second coupler is movably connected to the first structural member; and the second coupler is fixedly connected to the building structure; (v) the second coupler is fixedly connected to the first structural member; and the second coupler is movably connected to the building structure; or (vi) the second coupler is movably connected to the first structural member; and the second coupler is movably connected to the building structure. In one or more embodiments: (iv) the second coupler is movably connected to a second structural member of the plurality of structural members; and the second coupler is fixedly connected to the building structure; (v) the second coupler is fixedly connected to the second structural member; and the second coupler is movably connected to the building structure; or (vi) the second coupler is movably connected to the second structural member; and the second coupler is movably connected to the building structure.

A method has also been disclosed. The method generally includes: connecting a framing section to a building structure, the framing section including: a plurality of structural members; and a first coupler connected to a first structural member of the plurality of structural members; and after connecting the framing section to the building structure, permitting, via the first coupler, relative movement between the framing section and the building structure in a first direction. In one or more embodiments, the method further includes: before connecting the framing section to the building structure, connecting a plurality of sheeting sections to the framing section. In one or more embodiments, connecting the framing section to the building structure includes: (i) movably connecting the first coupler to the first structural member; and fixedly connecting the first coupler to the building structure; (ii) fixedly connecting the first coupler to the first structural member; and movably connecting the first coupler to the building structure; or (iii) movably connecting the first coupler to the first structural member; and movably connecting the first coupler to the building structure. In one or more embodiments, the framing section further includes a second coupler; and the method further includes: after connecting the framing section to the building structure, permitting, via the second coupler, relative movement between the framing section and the building structure in a second direction, which second direction is the same as the first direction. In one or more embodiments, connecting the framing section to the building structure further includes: (iv) movably connecting the second coupler to the first structural member; and fixedly connecting the second coupler to the building structure; (v) fixedly connecting the second coupler to the first structural member; and movably connecting the second coupler to the building structure; or (vi) movably connecting the second coupler to the first structural member; and movably connecting the second coupler to the building structure. In one or more embodiments, connecting the framing section to the building structure further includes: (iv) movably connecting the second coupler to a second structural member of the plurality of structural members; and fixedly connecting the second coupler to the building structure; (v) fixedly connecting the second coupler to the second structural member; and movably connecting the second coupler to the building structure; or (vi) movably connecting the second coupler to the second structural member; and movably connecting the second coupler to the building structure.

An apparatus has also been disclosed. The apparatus generally includes: a framing section adapted to be connected to a building structure, the framing section including: a plurality of structural members; and a first coupler connected to a first structural member of the plurality of structural members; wherein, when the framing section is connected to the building structure, the first coupler is adapted to permit relative movement between the framing section and the building structure in a first direction. In one or more embodiments, the first coupler includes: a support plate; and a fastener; wherein the fastener extends through an elongated slot to movably connect the support plate to the first structural member; and wherein the elongated slot is formed in the support plate, the first structural member, or both. In one or more embodiments, the apparatus further includes: a plurality of sheeting sections adapted to be connected to the framing section, on a side of the framing section opposite the building structure. In one or more embodiments: (i) the first coupler is movably connected to the first structural member; and the first coupler is adapted to be fixedly connected to the building structure; (ii) the first coupler is fixedly connected to the first structural member; and the first coupler is adapted to be movably connected to the building structure; or (iii) the first coupler is movably connected to the first structural member; and the first coupler is adapted to be movably connected to the building structure. In one or more embodiments, the framing section further includes a second coupler; and, when the framing section is connected to the building structure, the second coupler is adapted to permit relative movement between the framing section and the building structure in a second direction, which second direction is the same as the first direction. In one or more embodiments: (iv) the second coupler is movably connected to the first structural member; and the second coupler is adapted to be fixedly connected to the building structure; (v) the second coupler is fixedly connected to the first structural member; and the second coupler is adapted to be movably connected to the building structure; or (vi) the second coupler is movably connected to the first structural member; and the second coupler is adapted to be movably connected to the building structure. In one or more embodiments: (iv) the second coupler is movably connected to a second structural member of the plurality of structural members; and the second coupler is adapted to be fixedly connected to the building structure; (v) the second coupler is fixedly connected to the second structural member; and the second coupler is adapted to be movably connected to the building structure; or (vi) the second coupler is movably connected to the second structural member; and the second coupler is adapted to be movably connected to the building structure.

It is understood that variations may be made in the foregoing without departing from the scope of the present disclosure.

In one or more embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In one or more embodiments, while different steps, processes, and procedures are described as appearing as distinct acts, one or more of the steps, one or more of the processes, and/or one or more of the procedures may also be performed in different orders, simultaneously and/or sequentially. In one or more embodiments, the steps, processes, and/or procedures may be merged into one or more steps, processes and/or procedures. In one or more embodiments, one or more of the operational steps in each embodiment may be omitted. Moreover, in some instances, some features of the present disclosure may be employed without a corresponding use of the other features. Moreover, one or more of the embodiments disclosed above and in the Appendix of the '268 Application, or variations thereof, may be combined in whole or in part with any one or more of the other embodiments described above and in the Appendix, or variations thereof.

Although several embodiments have been described in detail above and in the Appendix of the '268 Application, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A wall module, comprising:

a framing section configured to be movably connected to a building structure, the framing section comprising:

a plurality of structural members, comprising:

two or more first structural members spaced apart in a parallel relation; and two or more second structural members rigidly interconnecting the two or more first structural members;

a first coupler connected to at least one of the plurality of structural members; and a second coupler connected to at least one of the plurality of structural members; and a plurality of sheeting sections rigidly connected to the framing section, wherein, when the framing section is connected to the building structure:

the second coupler is vertically spaced apart from the first coupler, and the first and second couplers are each configured to permit relative movement between the wall module, including the framing section and the plurality of sheeting sections, and the building structure in a same direction.

2. The wall module of claim 1, wherein the first coupler comprises:

a support plate; and a fastener;

wherein the fastener extends through an elongated slot to movably connect the support plate to the first structural member; and wherein the elongated slot is formed in the support plate, the first structural member, or both.

3. The wall module of claim 1, wherein:

(i) the first coupler is movably connected to at least one of the two or more first structural members; and the first coupler is adapted to be fixedly connected to the building structure;

or (ii) the first coupler is fixedly connected to the at least one of the two or more first structural members; and the first coupler is adapted to be movably connected to the building structure;

or (iii) the first coupler is movably connected to the at least one of the two or more first structural members; and the first coupler is adapted to be movably connected to the building structure.

4. The wall module of claim 3, wherein:

(iv) the second coupler is movably connected to the at least one of the two or more first structural members; and the second coupler is adapted to be fixedly connected to the building structure;

or (v) the second coupler is fixedly connected to the at least one of the two or more first structural members; and the second coupler is adapted to be movably connected to the building structure;

or (vi) the second coupler is movably connected to the at least one of the two or more first structural members; and the second coupler is adapted to be movably connected to the building structure.

5. The wall module of claim 3, wherein:

(iv) the second coupler is movably connected to at least another one of the two or more first structural members of the plurality of structural members; and the second coupler is adapted to be fixedly connected to the building structure;

or (v) the second coupler is fixedly connected to the second at least another one of the two or more first structural members; and the second coupler is adapted to be movably connected to the building structure;

or (vi) the second coupler is movably connected to the second at least another one of the two or more first structural members; and the second coupler is adapted to be movably connected to the building structure.

6. A system, comprising:

a building structure; and a wall module, comprising:

a framing section movably connected to the building structure, the framing section comprising:

a plurality of structural members, comprising:

two or more first structural members spaced apart in a parallel relation; and two or more second structural members rigidly interconnecting the two or more first structural members;

a first coupler connected to at least one of the plurality of structural members; and a second coupler connected to at least one of the plurality of structural members; and a plurality of sheeting sections rigidly connected to the framing section on a side of the framing section opposite the building structure, wherein the second coupler is vertically spaced apart from the first coupler, and wherein the first and second couplers each permit relative movement between the wall module, including the framing section and the plurality of sheeting sections, and the building structure in a same direction.

7. The system of claim 6, wherein the first coupler comprises:

a support plate; and a fastener;

wherein the fastener extends through an elongated slot to movably connect the support plate to the first structural member; and wherein the elongated slot is formed in the support plate, the first structural member, or both.

8. The system of claim 6, wherein:

(i) the first coupler is movably connected to at least one of the two or more first structural members; and the first coupler is fixedly connected to the building structure;

or (ii) the first coupler is fixedly connected to the at least one of the two or more first structural members; and the first coupler is movably connected to the building structure;

or (iii) the first coupler is movably connected to the at least one of the two or more first structural members; and the first coupler is movably connected to the building structure.

9. The system of claim 8, wherein:

(iv) the second coupler is movably connected to the at least one of the two or more first structural members; and the second coupler is fixedly connected to the building structure;

or (v) the second coupler is fixedly connected to the at least one of the two or more first structural members; and the second coupler is movably connected to the building structure;

or (vi) the second coupler is movably connected to the at least one of the two or more first structural members; and the second coupler is movably connected to the building structure.

10. The system of claim 8, wherein:

(iv) the second coupler is movably connected to a second at least another one of the two or more first structural members of the plurality of structural members; and the second coupler is fixedly connected to the building structure;

or (v) the second coupler is fixedly connected to the at least another one of the two or more first structural members; and the second coupler is movably connected to the building structure;

or (vi) the second coupler is movably connected to the at least another one of the two or more first structural members; and the second coupler is movably connected to the building structure.

11. A method, comprising:

movably connecting a framing section of a wall module to a building structure, the wall module comprising:

the framing section, the framing section comprising:

a plurality of structural members, comprising:

two or more first structural members spaced apart in a parallel relation; and two or more second structural members rigidly interconnecting the two or more first structural members;

a first coupler connected to at least one of the plurality of structural members; and a second coupler connected to at least one of the plurality of structural members, said second coupler being vertically spaced apart from the first coupler when the framing section of the wall module is movably connected to the building structure; and a plurality of sheeting sections;

before movably connecting the framing section of the wall module to the building structure, rigidly connecting the plurality of sheeting sections to the framing section; and after movably connecting the framing section of the wall module to the building structure, permitting, via each of the first and second couplers, relative movement between the wall module, including the framing section and the plurality of sheeting sections, and the building structure in a same direction.

12. The method of claim 11, wherein connecting the framing section to the building structure comprises:

(i) movably connecting the first coupler to at least one of the two or more first structural members; and
fixedly connecting the first coupler to the building structure;

or (ii) fixedly connecting the first coupler to the at least one of the two or more first structural members; and
movably connecting the first coupler to the building structure;

or (iii) movably connecting the first coupler to the at least one of the two or more first structural members; and
movably connecting the first coupler to the building structure.

13. The method of claim 12, wherein connecting the framing section to the building structure further comprises:

(iv) movably connecting the second coupler to the at least one or the two or more first structural members; and
fixedly connecting the second coupler to the building structure;

or (v) fixedly connecting the second coupler to the at least one of the two or more first structural members; and
movably connecting the second coupler to the building structure;

or (vi) movably connecting the second coupler to the at least one of the two or more first structural members; and
movably connecting the second coupler to the building structure.

14. The method of claim 12, wherein connecting the framing section to the building structure further comprises:

(iv) movably connecting the second coupler to at least another one of the two or more first structural members of the plurality of structural members; and
fixedly connecting the second coupler to the building structure;

or (v) fixedly connecting the second coupler to the at least another one of the two or more first structural members; and
movably connecting the second coupler to the building structure;

or (vi) movably connecting the second coupler to the second at least another one of the two or more first structural members; and
movably connecting the second coupler to the building structure.

* * * * *